US007942713B2

(12) United States Patent
Takegami

(10) Patent No.: US 7,942,713 B2
(45) Date of Patent: May 17, 2011

(54) METHOD OF FABRICATING AN ELECTRON-EMITTING DEVICE INCORPORATING A CONDUCTIVE FILM CONTAINING FIRST AND SECOND PARTICLES HAVING DIFFERENT RESISTANCE VALUES

(75) Inventor: Tsuyoshi Takegami, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 947 days.

(21) Appl. No.: 11/565,108

(22) Filed: Nov. 30, 2006

(65) Prior Publication Data

US 2007/0135012 A1 Jun. 14, 2007

(30) Foreign Application Priority Data

Dec. 13, 2005 (JP) ..... 2005-359074
Nov. 21, 2006 (JP) ..... 2006-314405

(51) Int. Cl.
*H01J 9/00* (2006.01)
*H01J 9/02* (2006.01)

(52) U.S. Cl. ..... 445/6; 445/51

(58) Field of Classification Search ..... 445/24, 445/25, 49–51, 3, 6
See application file for complete search history.

(56) References Cited

U.S. PATENT DOCUMENTS

| | | | | |
|---|---|---|---|---|
| 5,066,883 | A | 11/1991 | Yoshioka et al. | 313/309 |
| 5,532,544 | A | 7/1996 | Yoshioka et al. | 313/310 |
| 5,645,462 | A * | 7/1997 | Banno et al. | 445/51 |
| 5,661,362 | A | 8/1997 | Yoshioka et al. | 313/309 |
| 5,674,100 | A * | 10/1997 | Ono et al. | 445/24 |
| 5,749,763 | A | 5/1998 | Yoshioka et al. | 445/51 |
| 5,759,080 | A | 6/1998 | Yoshioka et al. | 445/51 |
| 5,872,541 | A | 2/1999 | Yoshioka et al. | 345/74 |
| 6,184,610 | B1 * | 2/2001 | Shibata et al. | 313/309 |
| 6,288,485 | B1 | 9/2001 | Takegami et al. | 313/495 |
| 6,346,773 | B1 | 2/2002 | Takegami | 315/169.1 |
| 6,380,665 | B1 | 4/2002 | Motoi et al. | 313/310 |
| 6,851,995 | B2 | 2/2005 | Takegami et al. | 445/6 |
| 6,929,522 | B1 | 8/2005 | Takegami | 445/6 |
| 6,960,111 | B2 | 11/2005 | Takegami et al. | 445/24 |
| 7,249,990 | B2 | 7/2007 | Shimazu et al. | 445/50 |
| 2002/0096986 | A1 | 7/2002 | Motoi et al. | 313/310 |
| 2003/0161942 | A1 | 8/2003 | Arai et al. | 427/77 |
| 2005/0052108 | A1 | 3/2005 | Motoi et al. | 313/310 |
| 2007/0209192 | A1 | 9/2007 | Shimazu et al. | 29/592.1 |

FOREIGN PATENT DOCUMENTS

| | | | |
|---|---|---|---|
| JP | 1-93024 | | 4/1989 |
| JP | 1-112633 | | 5/1989 |
| JP | 08031306 | A * | 2/1996 |
| JP | 09161656 | A * | 6/1997 |
| JP | 9-330649 | | 12/1997 |
| JP | 10012132 | A * | 1/1998 |
| JP | 10-50208 | | 2/1998 |
| JP | 2000011861 | A * | 1/2000 |
| JP | 2000-231872 | | 8/2000 |
| JP | 2003068192 | A * | 3/2003 |

* cited by examiner

*Primary Examiner* — Mariceli Santiago
(74) *Attorney, Agent, or Firm* — Fitzpatrick, Cella, Harper & Scinto

(57) ABSTRACT

An object hereof is to provide a method of making, a gap, which can provide good electron-emitting properties, simply, with low electric power and in short time. A method of fabricating an electron-emitting device, including a process of flowing a current in electroconductive film containing first particles and second particles including resistance lower than resistance of the first particle and thereby forming a gap in a portion of the above described electroconductive film, wherein the ratio of the above described first particle contained in the above described film is not less than 2% and not more than 30% and the ratio of resistance of the above described first particle to resistance of the above described second particle is not less than 5 and not more than 1000.

20 Claims, 18 Drawing Sheets

FIG. 7

CONTAINING RATIO OF 1st PARTICLE

| RESISTANCE RATIO (RESISTANCE OF 1st PARTICLE/RESISTANCE OF 2nd PARTICLE) | 0% | 2% | 5% | 10% | 20% | 30% | 40% | 50% | 60% | 70% | 80% | 90% | 100% |
|---|---|---|---|---|---|---|---|---|---|---|---|---|---|
| 2 | × | × | × | × | × | × | × | × | × | × | × | × | × |
| 5 | × | ○ | ○ | ○ | ○ | ○ | ○ | ○ | ○ | × | × | × | × |
| 10 | × | ○ | ○ | ○ | ○ | ○ | ○ | ○ | ○ | × | × | × | × |
| 30 | × | ○ | ○ | ○ | ○ | ○ | ○ | ○ | ○ | × | × | × | × |
| 50 | × | ○ | ○ | ○ | ○ | ○ | ○ | ○ | ○ | × | × | × | × |
| 70 | × | ○ | ○ | ○ | ○ | ○ | ○ | ○ | ○ | × | × | × | × |
| 100 | × | ○ | ○ | ○ | ○ | ○ | ○ | ○ | ○ | × | × | × | × |
| 200 | × | ○ | ○ | ○ | ○ | ○ | ○ | ○ | ○ | × | × | × | × |
| 300 | × | ○ | ○ | ○ | ○ | ○ | ○ | ○ | ○ | × | × | × | × |
| 400 | × | ○ | ○ | ○ | ○ | ○ | ○ | ○ | ○ | × | × | × | × |
| 800 | × | ○ | ○ | ○ | ○ | ○ | ○ | × | × | × | × | × | × |
| 1000 | × | ○ | ○ | ○ | ○ | ○ | × | × | × | × | × | × | × |
| 2000 | × | × | × | × | × | × | × | × | × | × | × | × | × |
| 5000 | × | × | × | × | × | × | × | × | × | × | × | × | × |

METHOD OF FABRICATING AN ELECTRON-EMITTING DEVICE INCORPORATING A CONDUCTIVE FILM CONTAINING FIRST AND SECOND PARTICLES HAVING DIFFERENT RESISTANCE VALUES

BACKGROUND OF THE INVENTION

1. Field of the Invention

The present invention relates to an electron-emitting device and an image display apparatus as well as an electron source therewith. In addition, the present invention relates to an information display and reproduction apparatus such as a television set and the like for receiving signals of a broadcast such as a television broadcast and the like and for displaying and reproducing video information, text information and audio information included in the broadcast signals.

2. Description of the Related Art

Conventionally, there known as an electron-emitting device are surface conduction electron-emitting devices disclosed in Japanese Patent Application Laid-Open No. 2000-231872, Japanese Patent Application Laid-Open No. H01-112633, Japanese Patent Application Laid-Open No. H01-093024, Japanese Patent Application Laid-Open No. H10-050208 and Japanese Patent Application Laid-Open No. H09-330649. An example of a process of making a surface conduction electron-emitting device will be described below with FIG. 15A to FIG. 15D.

At first, a pair of auxiliary electrodes (2 and 3) are formed on a substrate 1 substantially having insulation properties (FIG. 15A). Subsequently, the pair of auxiliary electrodes (2 and 3) are connected with electroconductive film 4 (FIG. 15B). Japanese Patent Application Laid-Open No. H09-330649 has disclosed electrically conductive film 4 comprising Ni and Ni oxides with Ni in the Ni oxides being not less than 5 atomic % and not more than 90 atomic % of the entire Ni in the electroconductive film 4. In addition, as the Ni oxides, NiO and $Ni_2O_3$ are disclosed as the Ni oxide. In addition, it is also disclosed that the electroconductive film 4 is configured by fine particle film.

In addition, by applying a voltage between the pair of auxiliary electrodes (2 and 3), an operation of the part of the electroconductive film 4 undergoes a process called "energization forming" of forming a first gap 7 (FIG. 15C).

The "energization forming" operation is a process of causing a current to flow in the electroconductive film 4 to form the first gap 7 in the part of the electroconductive film 4 with Joule heat attributable to the current. That "energization forming" operation makes it possible to form a pair of electrodes (4*a* and 4*b*) facing each other with the intervening first gap 7. And, preferably, an operation called "activation" is carried out. The "activation" operation typically includes a process of applying a voltage between the pair of the auxiliary electrodes (2 and 3) in a gas atmosphere containing carbon. That process forms electroconductive carbon films (21*a* and 21*b*) on the substrate 1 inside the first gap 7 and on the electrodes (4*a* and 4*b*) in the vicinity of the first gap 7 (FIG. 15D). Consequently, a second gap 8 defined by the gap between the first carbon film 21*a* and the second carbon film 21*b* is formed inside the first gap 7. The "activation" operation occasionally can improve electron-emitting performance compared with an electron-emitting device formed only in the "energization forming" operation. The process described above forms an electron-emitting device.

An image display apparatus can be configured by causing an electron source composed of a plurality of the electron-emitting devices and a substrate comprising light emitting member film comprising a phosphor and the like to face each other and retaining the space between them at pressure (typically in vacuum) lower than the atmosphere pressure.

FIG. 16A is a plan diagram schematically showing the electron-emitting device after having undergone the above described "activation" operation. FIG. 16B shows schematically section along the 16B-16B line in FIG. 16A and is basically the same diagram as FIG. 15D. On the occasion of causing the above described electron-emitting device to emit electrons, potential applied to an auxiliary electrode (2 or 3) is made higher than the potential applied to the other auxiliary electrode (3 or 2). Thus applying a voltage between the auxiliary electrode 2 and the auxiliary electrode 3, an intensive electric field is generated in the second gap 8. Consequently, it is understood that electrons are emitted from a large number of points (a plurality of electron-emitting sites) of a portion being an end circumference of the carbon film (21*a* or 21*b*) connected to the auxiliary electrode (3 or 2) on the low potential side, configuring an outer circumference of the second gap 8.

SUMMARY OF THE INVENTION

A method of carrying out an energization operation on the electroconductive film 4 made of metal in the vacuum and a method of carrying out the energization operation on the electroconductive film 4 made of metal oxide under an atmosphere containing reducible gas, for example, are nominated as a method of the above described conventional "energization forming" operation.

However, although the method of energizing the electroconductive film 4 made of metal is simple and convenient, the electric energy required for the "energization forming" operation will get larger. Therefore, "energization forming" operation has given rise to such as a problem that required device performance will get to a high level. In addition, in the case of assuming a display sized not less than 30 inches, when a large number of sheets of electroconductive film made of metal are tried to concurrently undergo an "energization forming operation" in order to shorten fabrication time, the amount of current that should flow in wiring to bring the conductive film into common connection will increase enormously. Consequently, wiring allowing a large current to flow will be required. In addition, voltage drop originated attributable to wiring resistance takes place so that voltage applied to respective sheets of electroconductive film will occasionally become different, frequently giving rise to dispersion in the shape of the formed gaps.

On the other hand, the method of causing electroconductive film made of metal oxide such as PdO to undergo the "energization forming" operation under an atmosphere containing reducible gas (such as hydrogen), the electric energy required for the "energization forming" operation can be restrained compared with carrying out the "energization forming" operation on the electroconductive film made of metal. However, control on an atmosphere containing a reducible gas and control to the reducible level of electroconductive film will be required and, therefore, will become complicated compared with such a case of causing electroconductive film made of metal to undergo the "energization forming" operation in the vacuum. In addition, since it is required to change resistance of electroconductive film gradually utilizing heat generated in the electroconductive film 4 with "energization forming" operation, time required for the "energization forming" operation will get longer. In addition, carrying out the "energization forming" operation on a large number of sheets of electroconductive thin film under a reducible atmosphere, all the sheets of the electroconductive film cannot concurrently undergo the operation and, therefore, dispersion occasionally takes place on changes in resistance value of the electroconductive film during an operation, frequently giving rise to dispersion in the shape of the formed gaps.

Therefore, an object of the present invention is to provide a method of making, formable, a gap making, attainable, good electron-emitting performance which is simple likewise in the case of the electroconductive film 4 made of metal, requires low electric power likewise in the case of electroconductive film 4 made of metal oxide and in short time.

That is, the first invention of the present invention is a method of fabricating an electron-emitting device, "including a process of flowing a current through a film containing a large number of first particles made of a first material and a large number of second particles comprising resistance lower than that of the first particle and made of second material different from the above described first material, wherein the above described film satisfies any one of conditions:

(i) the ratio of the above described first particles contained in the above described film is not less than 2% and not more than 30% and the ratio of resistance of the above described first particle to resistance of the above described second particle is not less than 5 and not more than 1000;

(ii) the ratio of the above described first particles contained in the above described film is not less than 2% and not more than 40% and the ratio of resistance of the above described first particle to resistance of the above described second particle is not less than 5 and not more than 800; and (iii) the ratio of the above described first particles contained in the above described film is not less than 2% and not more than 60% and the ratio of resistance of the above described first particle to resistance of the above described second particle is not less than 5 and not more than 400."

The second invention of the present invention is a method of fabricating an electron-emitting device, "including a process of flowing a current through a film containing a large number of first particles made of a first material and a large number of second particles comprising resistance lower than that of the first particle and made of second material different from the above described first material, wherein the ratio of said first particle contained in said film is not less than 2% and not more than 50%;

the ratio of resistance of said first particle to resistance of said second particle being not less than 50 and not more than 400; and standard deviation of said first particle and second particle is not more than 33.3% of an average particle size."

In addition, the above described present invention is further marked in that: "the above described current flows in the above described film under a pressure not more than $1\times10^{-5}$ Pa"; "the above described film is disposed so as to bring a first auxiliary electrode and a second auxiliary electrode into connection, a voltage pulse is applied between the first auxiliary electrode and the second auxiliary electrode and thereby the above described current flows in the above described film"; "the above described film is a film containing the above described first particles and the above described second particles nonhomogeneously"; and "an average particle size of the above described first particle and second particle is not less than 5 nm and not more than 20 nm."

Moreover, the present invention is also marked by a method of fabricating an electron source comprising a plurality of electron-emitting device for fabrication with the above described fabrication method.

In addition, the present invention is also marked by a method of fabricating an image display apparatus comprising an electron source fabricated with the above described fabrication method and a light emitting member irradiated with electrons emitted from the electron source.

For a method of fabricating an electron-emitting device of the present invention, electroconductive film containing particles made of at least two kinds of material (first particle and second particle) is configured and a resistance ratio of the first particle to the second particle and a containing ratio of the first particle are set as described above. Consequently, a large number of points (portions) of causing electric field concentration (current concentration) efficiently at the time of an "energization forming" operation can be produced in advance. Consequently, there formable is a gap that can make it possible to cause good electron-emitting properties to appear simply with small electric power with good reproducibility in short time.

Further features of the present invention will become apparent from the following description of exemplary embodiments with reference to the attached drawings.

BRIEF DESCRIPTION OF THE DRAWINGS

FIG. 7 is a table showing a mode of gaps formed corresponding with changes in the containing ratio of configuring material of electroconductive film and in resistance of configuring material.

DESCRIPTION OF THE EMBODIMENTS

A method of fabricating an electron-emitting device of the present invention will be described with FIG. 1A to FIG. 1C and FIG. 2A to FIG. 2C. FIG. 2A to FIG. 2C are schematic plan views and FIG. 1A to FIG. 1C are respectively schematic sections along dotted lines 1A-1A, 1B-1B and 1C-1C in FIG. 2A to FIG. 2C.

A method of fabricating an electron-emitting device of the present invention is established basically as described below in (process 1) and (process 2).

(Process 1)

Figure 1A:
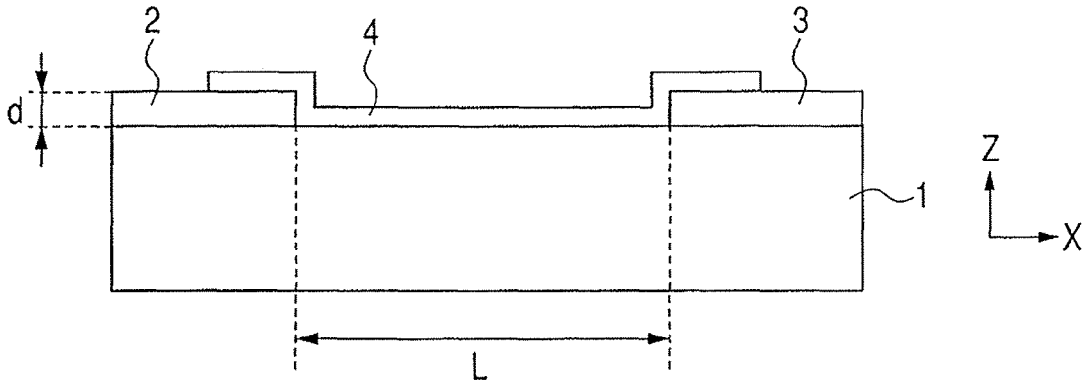
FIG. 1A, FIG. 1B and FIG. 1C show schematically section of an example of a fabrication method of the present invention.
Figure 1B:
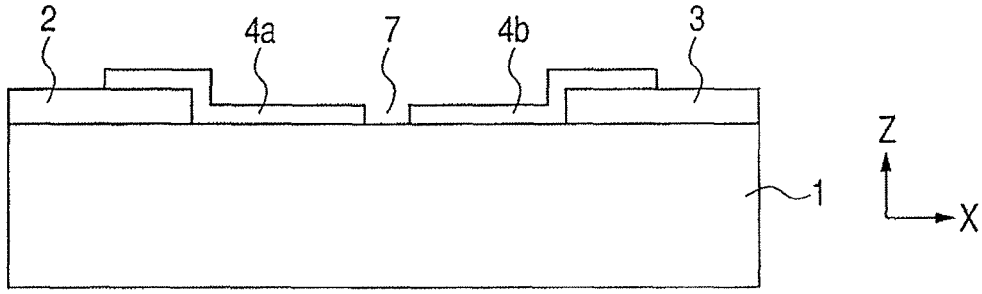
Figure 1C:
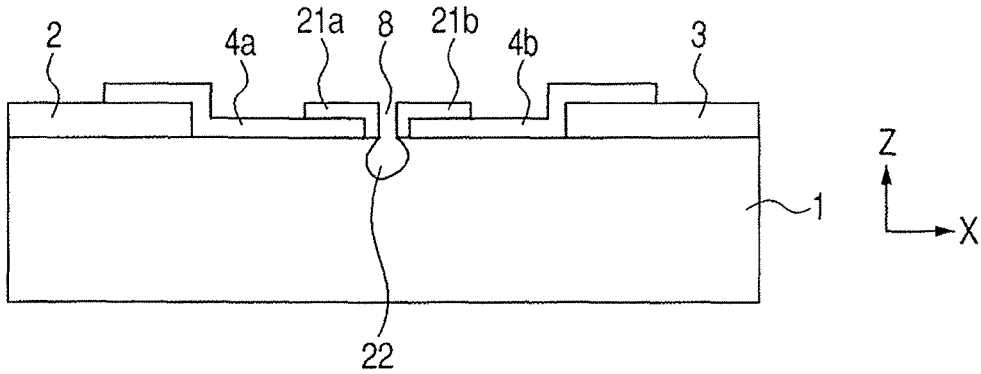
Figure 2A:
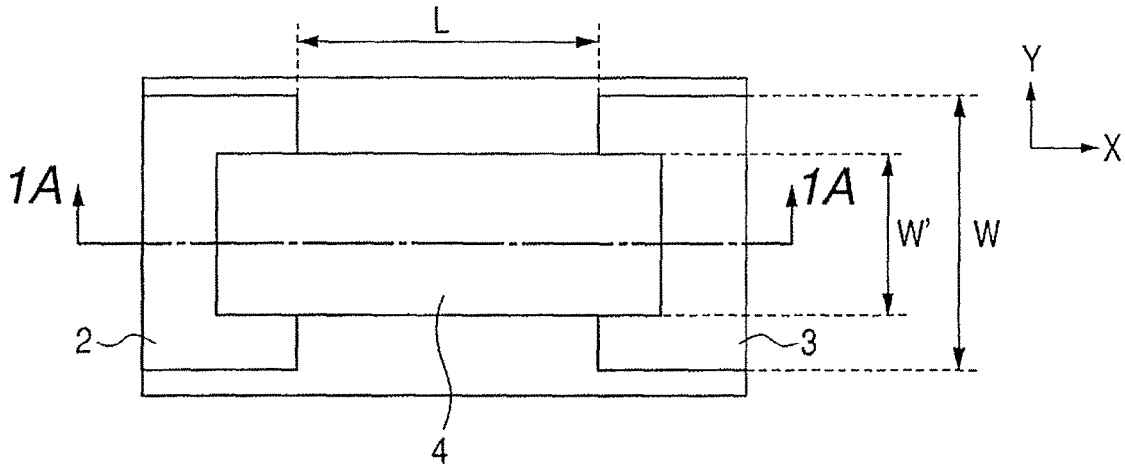
FIG. 2A, FIG. 2B and FIG. 2C show schematic plan diagrams of an example of a fabrication method of the present invention.
Figure 2B:
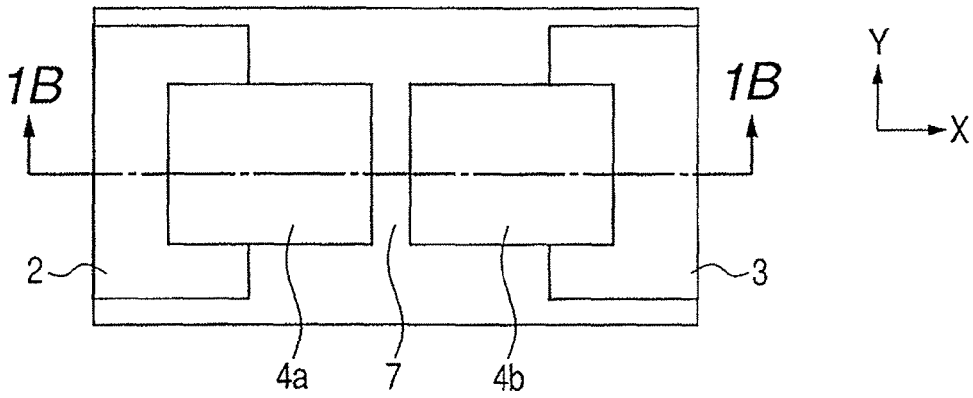
Figure 2C:
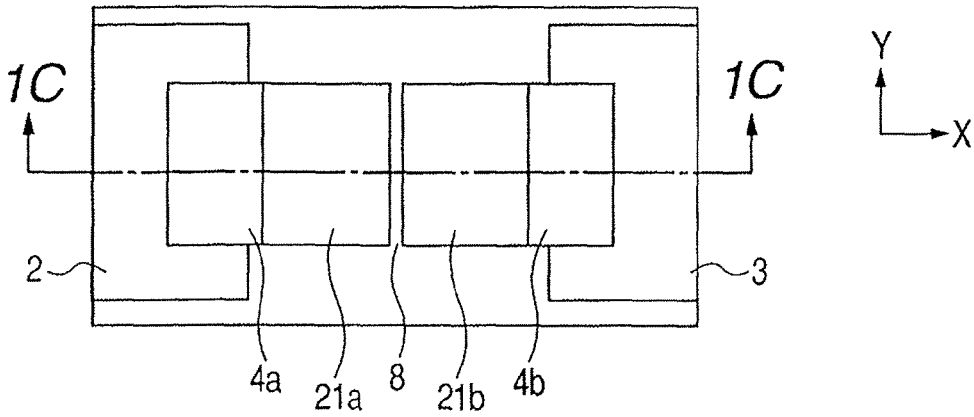

There prepared is a substrate 1 on which electroconductive film 4 (to be described below in detail) comprising second particles comprising particles with low resistance and first particles comprising particles with high resistance is disposed (FIG. 1A and FIG. 2A). Here, FIG. 1A shows schematically section along the dotted line 1A-1A in FIG. 2A. Practical average particle size of the first particles and the second particles is preferably not less than 5 nm (equal to or more than 5 nm) and not more than 20 nm (equal to or less than 20 nm) based on resistance values and sizes obtained for electroconductive film 4 to be described below and the like. In addition, practically, in addition to the average particle size of the first particles and the second particles being not less than 5 nm and not more than 20 nm, the standard deviation ($\sigma$) of the particle size being not more than 33.3% of the average particle size makes it possible to carry out "energization forming" to be described below especially with good reproducibility and is especially preferable for attaining extremely good electron-emitting characteristics. Assuming that the particle size distribution is approximately normal distribution, the value 33.3% here is a value derived on the average particle size by that 99.9% (100%) falling within the range of $\pm 3\sigma$. In addition, practically the balance between the average particle size of the first particles and the average particle size of the second particles is preferred to be not more than 5 nm. In addition, if a morphology difference between the first particle and the second particle (the average particle size and/or standard deviation) is small, the second particles with low resistance and the first particles with high resistance can be also called as "particles made of lowly resistive material" and "particles made of highly resistive material" respectively. In addition, the average film thickness of the electroconductive film 4 in the present invention is preferably the same as or approximately the same as the average particle size of particles in order to carry out "energization forming" with good reproducibility. Practically, the average film thickness of the electroconductive film 4 is preferably not less than the average particle size and less than one and a half of the average particle size of particles in order to carry out "energization forming" with good reproducibility.

(Process 2)

Subsequently, causing the electroconductive film 4 to undergo the "energization forming" operation, the first gap 7 is formed (FIG. 1B and FIG. 2B). Here, FIG. 1B shows schematically section along a dotted line 1B-1B in FIG. 2B.

In addition, it is possible to add another process before and/or after the above described respective processes. For example, preferably, the "activation" operation to be described below will be carried out (FIG. 1C and FIG. 2C) as (process 3) after (process 2).

In addition, FIG. 1A to FIG. 1C and FIG. 2A to FIG. 2C show an example with the first auxiliary electrode 2 and the second auxiliary electrode 3, but the auxiliary electrodes (2 and 3) are not necessarily required since only the current flowing in the electroconductive film 4 is indispensable.

Here, the first gap 7 formed in the "energization forming" operation is extended approximately perpendicular to the current flowing direction (the direction in which the auxiliary electrode 2 faces the auxiliary electrode 3). The first gap 7 is not always line-shaped but occasionally meanderingly shaped. And meandering shape is adopted in majority. That process will produce a first electrode 4*a* and a second electrode 4*b* sandwiching the gap 7 and substantially facing each other. That is, ideally the electroconductive film 4 is completely divided into two portions by the gap 7. Here, the electroconductive film 4 may not be split into two portions completely (the first electrode 4*a* may be connected to the second electrode 4*b* in an extremely tiny region). Nevertheless if only the gap 7 (space between the first electrode 4*a* and the second electrode 4*b*) is formed in a sufficiently highly resistive state, there will be no effective problem.

Therefore, the "energization forming" operation finishes at the time when generation of the first gap 7 provides sufficiently high resistance between the first electrode 4*a* and the second electrode 4*b*. In other words, the "energization forming" operation finishes at the point of time when sufficiently high resistance is provided between the first auxiliary electrode 2 and the second auxiliary electrode 3.

The resistance value between the first electrode 4*a* and the second electrode 4*b* can be derived from the current flowing between the auxiliary electrode 2 and the auxiliary electrode 3 by, for example, applying a voltage (for example, a voltage around 0.1 V) between the auxiliary electrode 2 and the auxiliary electrode 3. Practically, at the point of time when the resistance value between the auxiliary electrode 2 and the auxiliary electrode 3 has reached not less than a 2-digit amount compared with pre-"energization forming" operation, the "energization forming" operation can be caused to finish. Thus, if the resistance value can be increased by not less than two digits before and after the "energization forming" process, a ineffective current is made less at the time of a drive (at the time of electron emission) and an electron-emitting device with high electron-emitting efficiency (emitted current(Ie)/device current(If)) can be realized. However, it goes without saying that the gap 7 is assumed to be formed in the "energization forming" process. That is, even if the resistance value has increased by not less than two digits, the operation that does not form the gap 7 at all is not the "energization forming" operation of the present invention.

Here, the resistance value of the electroconductive film 4 before "energization forming" operation is appropriately selected in accordance with the size allowed for an electron-emitting device, the resistance value of wiring, the distance L between the auxiliary electrode 2 and the auxiliary electrode 3, the resistance value derived at the time of a drive and the like. However, a display with a size of not less than 30 inches, for example, is assumed to comprise electron-emitting devices being not less than 1920×1080 in number. A practical resistance value of the electroconductive film 4 before the "energization forming" operation is preferred to fall within a range of not less than 100Ω and not more than 100 kΩ. In addition, as to be described below with FIG. 18, the fabrication time is occasionally shortened by connecting a large number of sheets of the electroconductive film 4 to one wiring to cause a large number of sheets of electroconductive film 4 to undergo the "energization forming" operation substantially concurrently. Considering such a case, the range of resistance value of the electroconductive film 4 is practically preferred to fall within the range of not less than 8 kΩ and not more than 50 kΩ. In addition, film thickness of the electroconductive film 4 (replaceable to a particle size in many cases) is practically set to not less than 5 nm and not more than 40 nm, more preferably to not less than 5 nm and not more than 20 nm in view of reproducibility and due to providability of the resistance value described above. The electroconductive film 4 is formed with a large number of the first particles and a large number of the second particles so that the electroconductive film 4 comprises such a resistance value range and a film thickness range.

Figure 9:
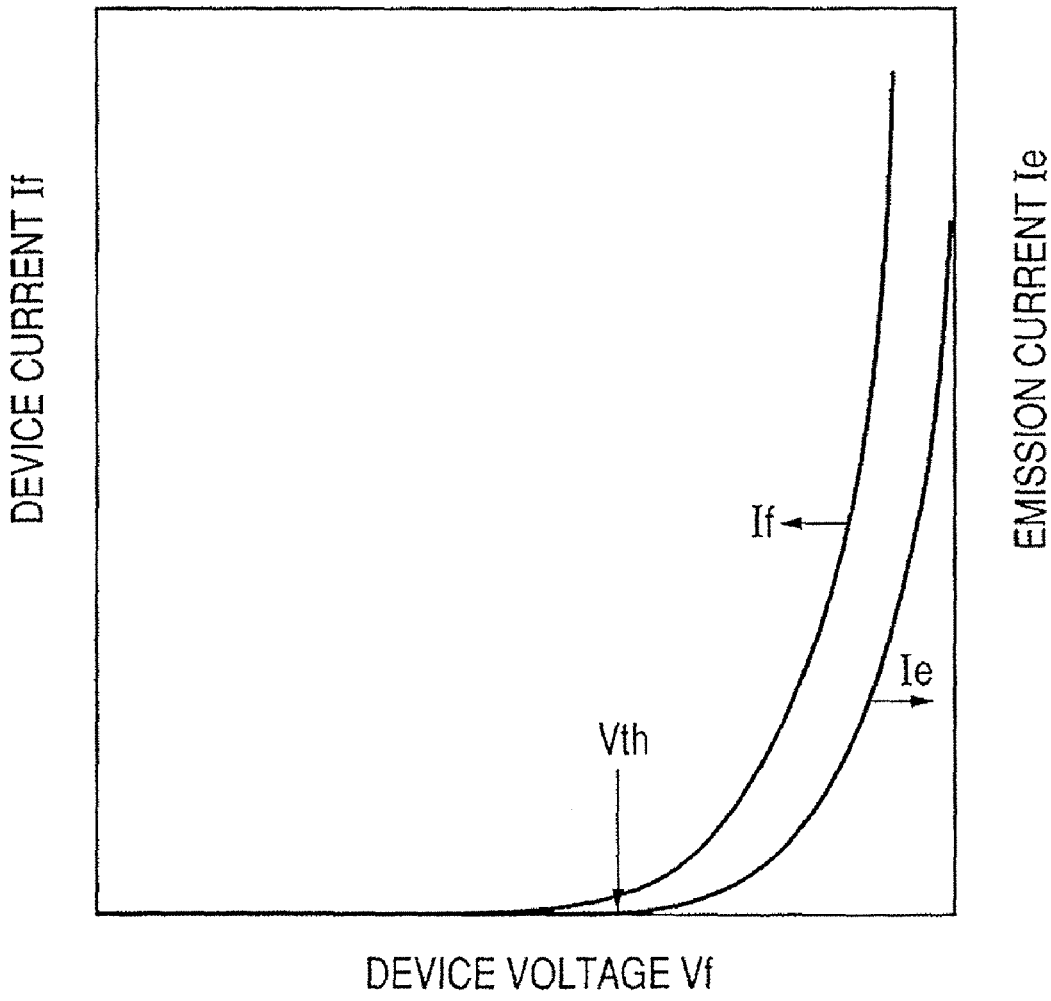
FIG. 9 shows schematically electron-emitting properties.

After the resistance value of the electroconductive film 4 has been successfully increased by not less than two digits with the "energization forming" operation in the present invention, the gap 7 is formed (effectively) from one end to the other end of the electroconductive film 4 in the direction substantially perpendicular to the direction in which the auxiliary electrode 2 and the auxiliary electrode 3 face each other. And, in view of the current If flowing between the auxiliary electrode 2 and the auxiliary electrode 3 and the voltage Vf applied between the auxiliary electrode 2 and the auxiliary electrode 3, non-linear properties as shown in FIG. 9 is obtained. Here, in the case where a good gap 7 is not formed (which can be restated "in the case where the resistance value is not increased by not less than two digits"), an ohmic current component remains between the auxiliary electrode 2 and the auxiliary electrode 3 and, therefore, sufficient non-linearity does not appear.

Figure 3A:
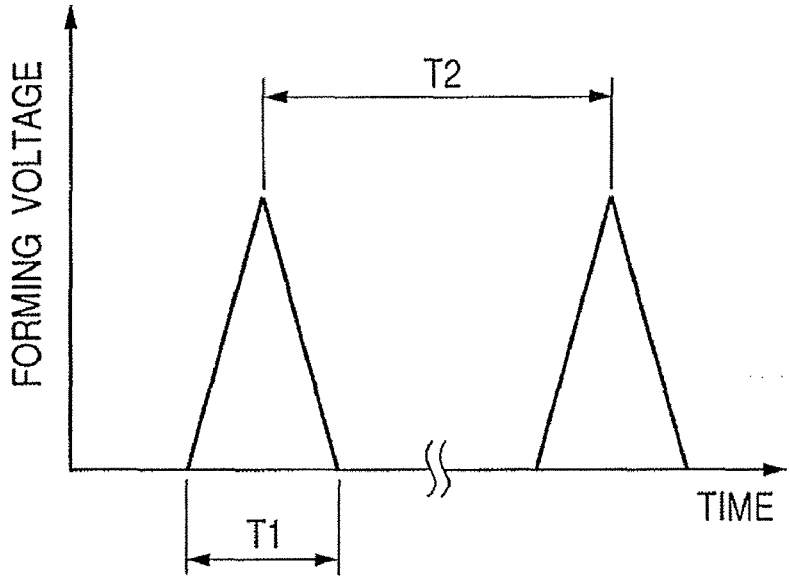
FIG. 3A and FIG. 3B show an example of voltage pulse usable for energization forming.
Figure 3B:
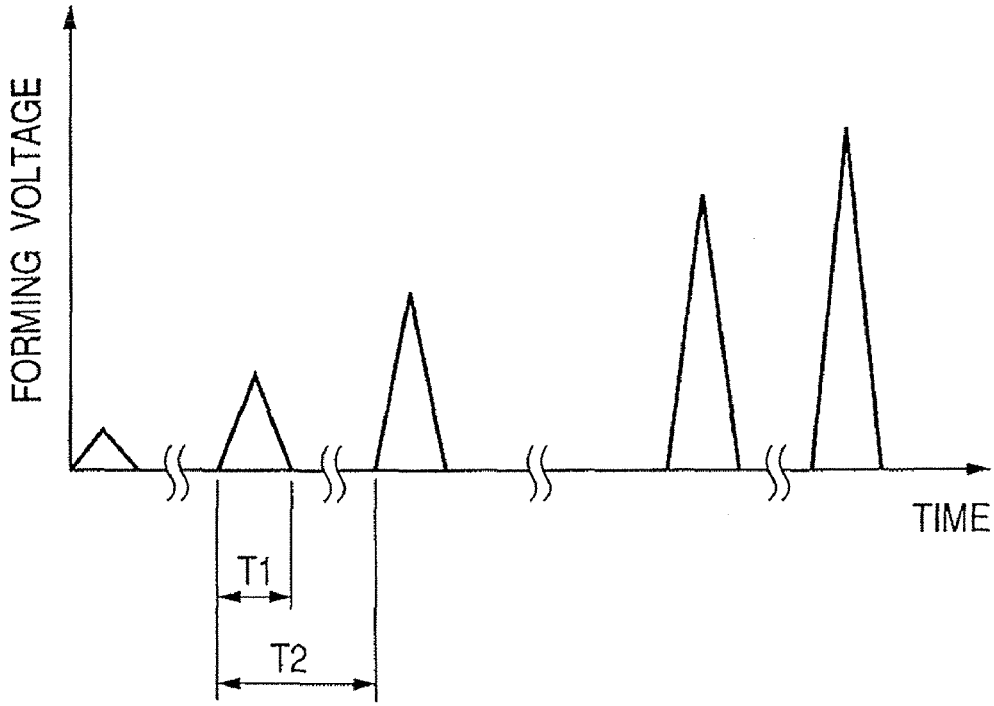

Preferably the "energization forming" operation is carried out by applying voltage pulse to the electroconductive film 4. And preferably the "energization forming" operation is carried out under a pressure of not more than $1\times10^{-5}$ Pa. FIGS. 3A and 3B depict a case where voltage pulse is applied repeatedly, but if the present invention is used, ideally the gap 7 can be formed in the electroconductive film 4 by applying a single voltage pulse. However, if the "energization forming" operation is carried out in a stabilized fashion, voltage pulse is preferably applied to the electroconductive film 4 a plurality of times. Application of voltage pulse a plurality of times is particularly preferable in the case where reproducibility is low in forming the electroconductive film 4 and in the case of connecting a large number of sheets of electroconductive film 4 to the same wiring and concurrently carrying out an "energization forming" operation on a large number of the electroconductive film 4 through the relevant wiring.

In the case where the voltage pulse is applied repeatedly, there is a technique shown in FIG. 3A where a crest value (voltage value) of pulse is made substantially constant and a technique shown in FIG. 3B where a crest value (voltage value) of pulse is varied in relation to time (voltage is increased or increase/decrease in voltage is repeated).

The time T1 and T2 in FIG. 3A and FIG. 3B is respectively pulse width and a pulse interval (dormant period) of voltage pulse. The time T1 is preferably set to within the range between not less than 1 μsec and not more than 10 msec and the time T2 to within the range between not less than 10 μsec and not more than 10 msec. The crest value (peak voltage) of the voltage pulse is appropriately selected in accordance with the mode of the electroconductive film 4 and the resistance value.

The waveform of the pulse to be used will not be limited to the triangular wave but a desired waveform such as a rectangular wave and the like can be adopted. The triangular wave in FIG. 3B can be increased step by step in around 0.1 V, for example.

An insulating or substantially insulating substrate is preferably used as the substrate 1. For example, a glass substrate whereon a silicon oxide layer (typically silica layer) is stacked, silica substrate, soda lime glass substrate, a ceramic substrate (such as alumina and the like) and silicon substrate may be used. For obtaining good electron-emitting properties, so called low alkali glass and non-alkali glass subject to decrease in alkali components such as Na and the like compared with the soda lime glass is preferably used as the glass substrate. In order to carry out "activation" to be described below well, it is preferable to use a substrate coated with silicon oxide layer (typically silica layer) on the low alkali glass substrate or non-alkali glass substrate.

In addition, the substrate 1 may be not only the structure configured by substrate itself described above but also an insulating or substantially insulating substrate disposed on a supporting member, for example. That is, there also preferable is a mode with a polygon (typically a rectangular parallelepiped structure or a structure approximated to a rectangular parallelepiped on) being formed on a glass substrate with a known technique such as photolithography method and with the electroconductive film 4 being disposed on the surface thereof. In such a case, such structure is preferable that the surface of the substrate on which the electroconductive film 4 is inclined at a predetermined angle (typically 90 degree or substantially 90 degree) to a plane surface of the electroconductive film (metal back or anode electrode) to which anode potential to be described below is applied. The surface on which the electroconductive film 4 is disposed is provided with a predetermined angle to the metal back or anode electrode and, thereby, the amount of electrons reaching the anode can be increased.

In the case of using the auxiliary electrodes (2 and 3), after the auxiliary electrodes (2 and 3) are disposed on the substrate 1, the electroconductive film 4 is preferably disposed so as to bring the first auxiliary electrode 2 and the second auxiliary electrode 3 into connection. In such a case, the electroconductive film 4 is preferable since coverage of at least respective portions of the first auxiliary electrode 2 and the second auxiliary electrode 3 can stabilize electric connection. General electrically conductive material can be used as the material of the auxiliary electrodes (2 and 3). For example, it is possible to use metal selected from the group consisting of Ag, Ni, Cr, Mo, W, Pt, Ti, Al, Cu and the like or alloys thereof and the like.

The distance L between the first auxiliary electrode 2 and the second auxiliary electrode 3 and width W of the auxiliary electrodes (2 and 3) are appropriately selected in consideration of a mode and the like to which the electron-emitting device is applied. The distance L is preferably set to fall within the range between not less than 1 μm and not more than 500 μm and more preferably set to fall within the range between not less than 1 μm and not more than 20 μm. The width (W) is preferably set to fall within a range between not less than 5 μm and not more than 200 μm in consideration of electron emission (Ie). The thickness d of the auxiliary electrodes (2 and 3) are preferably set to fall within the range between not less than 10 nm and not more than 10 μm. In addition, from the point of view of a stable supply of the current into the electroconductive film 4 and stability of electron emission at the time of a drive, it is preferable to set the width W of the auxiliary electrodes (2 and 3) larger than the width W' of the electroconductive film 4.

The electroconductive film 4 marking the present invention includes at least two types of particles (highly resistive particles and lowly resistive particles) being different in resistance. Therefore, it can be described that the electroconductive film 4 is configured by the first particles made of the highly resistive particles 71 and the second particles made of lowly resistive particles 70. Accordingly, the resistance of the first particle will be higher than the resistance of the second particle. In addition, a large number of the first particles and the second particles are respectively disposed in the electroconductive film 4. That is, the electroconductive film 4 contains a plurality of first particles and a plurality of second particles. In the present invention, as described above, if morphological difference in the above described two types of particle (standard deviation of the average particle size and/or the particle size) is not so substantial, the expression of "resistance" is equivalent to or substantially equivalent to the expression of "resistivity". Therefore, the first particle and the second particle are described as "a particle made of material with high resistivity compared with material configuring a second particle" and "a particle made of material with low resistivity compared with material configuring a first particle" respectively.

The above described first particle 71 and the second particle 70 are selected so as to satisfy the relationship of resistance ratio to be described below in detail. Here, "resistance ratio" means ratio of the first particle's resistance for the second particle's resistance. In other words, "resistance ratio" is a value described as (resistance of first particle 71)/(resistance of second particle 70). In addition, if morphological difference between the first particle and the second particle (the average particle size and/or standard deviation) is not so substantial, "resistance ratio" can be described as "(resistivity of material configuring the first particle)/(resistivity of material configuring the second particle)". The material configuring the first particle is preferably selected from the group consisting of cobalt oxide, nickel oxide, palladium oxide, bismuth oxide, iridium oxide, ruthenium oxide, amorphous carbon and the like. On the other hand, the material configuring the second particles is preferably selected from the group consisting of palladium, cobalt, platinum, bismuth, iridium, ruthenium and the like. In addition, the first particles and/or the second particles may be respectively configured by multiple elements as in an alloy. As an example of such a mode, there nominated is a case where the second particle is configured by an alloy of palladium and cobalt and the first particle is configured by amorphous carbon and the combination hereof is particularly preferable. Here resistivity of the bulk material is not necessarily proportional to the resistivity of material of particles on the nano order as in the present invention.

In addition, a containing ratio of first particle (ratio of the first particles contained in the electroconductive film 4) in the electroconductive film 4 is set so as to satisfy the relationship to be described below. Here, the electroconductive film 4 is enormously thin film. Therefore, the containing ratio of first particle (or second particle) in the electroconductive film 4 can be restated as "area occupancy of first particle (or second particle) in the electroconductive film 4". The above described containing ratio (area occupancy) can be calculated from containing ratio of first particle (area occupancy of first region) in the occasion of measuring by a device selected from the group consisting of FE-AES, ESCA, XPS, EPMA and the like to be described below typically from above the electroconductive film 4. Of course, it can also be computed from containing ratio of second particle (area occupancy of second region).

Here, the electroconductive film 4 of the present invention is also applicable to the case configured by three or more types of particles being mutually different in resistance.

The electroconductive film 4 is configured by a large number of particles since the gap 7 formed by "energization forming" operation to be described below can be formed with good reproducibility and with low electric power. The reason hereof is that a large number of field concentrated regions (current concentrated regions) to be described below are formed in the electroconductive film 4.

Here, a portion or the all portions of the large number of particles contained in the electroconductive film 4 may be in a mode in which mutually adjacent particles are sintered or partially melted (for example, in a shape selected from the group consisting of a bottle gourd shape or a peanut shape). The particle size of the particle (typically can be stipulated in the largest particle size (diameter)) does not have to be uniform, but as described above, difference in the particle morphology (average particle size and/or standard deviation) preferably had better be less.

The electroconductive film 4 of the present invention can be formed with various known fabrication methods selected from the group consisting of sputtering method, evaporation method, ink jet method and the like. For example, in the case of forming the electroconductive film 4 made of a large number of nickel oxide particles and a large number of platinum (Pt) particles with the ink jet method, a nickel complex and a platinum complex are dissolved in a solvent to prepare ink. And that ink is applied onto the substrate 1 described above with an ink jet apparatus. And, thereafter subject to baking in the oxygen-containing atmosphere, the electroconductive film containing nickel oxide particles and platinum particles can be formed. As a metal complex, a complex of an element selected from the group consisting of palladium, cobalt and the like can be nominated. In addition, preparing ink containing nickel oxide particles and platinum particles having been dispersed in a solvent (dispersion media), applying the ink to the substrate 1 with an ink jet method, a rotary application method and the like, and removing the solvent by baking the substrate 1, consequently the electroconductive film 4 can be formed.

The electroconductive film 4 suitably used to the present invention comprises a large number of regions where electric fields (or currents) are concentrated at the time of "energization forming" operation. Therefore, as the electroconductive film 4 becomes more nonhomogeneous (heterogeneous) film (film substantially lacking particular periodicity and regularity), effects of the present invention will become more remarkable. In order to obtain such a nonhomogeneous film, the electroconductive film 4 of the present invention is configured by film containing a large number of the first particles and a large number of the second particles in a mixed state.

In addition, various techniques can be adopted for the method of forming the above described nonhomogeneous film. For example, there employable is a method of forming the film by the sputtering method and the evaporation method so that respective film forming timing and film forming conditions are made mutually different for forming the first particles and the second particles. In addition, there employable is such a method that ink having the first particles and the second particles being dispersed in a solvent is provided so that the substrate 1 is applied with the ink using an ink jet method. Thus, various methods are considered, but the present invention will not be limited to such methods.

Figure 4:
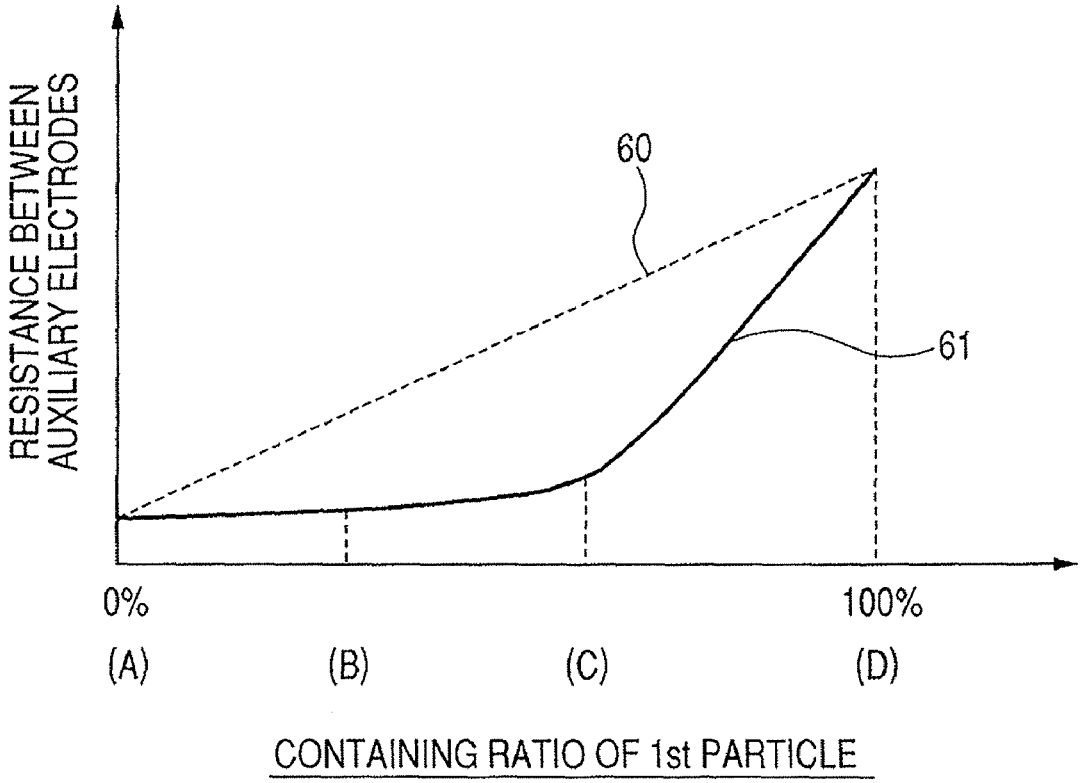
FIG. 4 shows a schematic graph showing correlation between the containing ratio of configuring material of electroconductive film and resistance value between auxiliary electrodes.

FIG. 4 shows the relationship between the containing ratio of first particles 71 contained in the electroconductive film 4 and the resistance value (resistance value of the electroconductive film 4) between the first auxiliary electrode 2 and the second auxiliary electrode 3. That is, (A) of FIG. 4 shows a case where the electroconductive film 4 is configured only by the second particles 70 and (D) of FIG. 4 shows a case where the electroconductive film 4 is configured only by the first particles 71. In addition, FIG. 5A to FIG. 5D schematically show the electroconductive film 4 containing the first particles 71 by percentages in FIG. 5A to FIG. 5D shown in the table in FIG. 4 respectively in top views.

In the case of mixing the first particles 71 and the second particles 70 together homogeneously (uniformly), the resistance value between the first auxiliary electrode 2 and the second auxiliary electrode 3 changes approximately linearly (see a dashed line 60 in FIG. 4) corresponding with changes in the percentage of the first particles 71 contained in the electroconductive film 4. On the other hand, in the case of mixing the first particles 71 and the second particles 70 together nonhomogeneously as in FIG. 5B and FIG. 5C, the resistance value between the first auxiliary electrode 2 and the second auxiliary electrode 3 changes non-linearly (see a solid line 61 in FIG. 4) corresponding with changes in the containing ratio of the first particle 71. That is, for the electroconductive film 4 having the first particles and the second particles being present nonhomogeneously (mixed nonhomogeneously) the resistance value between the first auxiliary electrode 2 and the second auxiliary electrode 3 changes non-linearly on the changes in area occupancy of the first particles.

Subsequently, a region where electric field (current) is concentrated inside the electroconductive film 4 in the midst of an "energization forming" operation will be described with FIG. 5A to FIG. 5D. Here, in FIG. 5A to FIG. 5D, reference numeral 1 denotes a substrate; reference numeral 2 denotes a first auxiliary electrode; reference numeral 3 denotes a second auxiliary electrode; reference numeral 4 denotes an electroconductive film; reference numeral 70 denotes second particles; and reference numeral 71 denotes first particles.

Figure 5A:
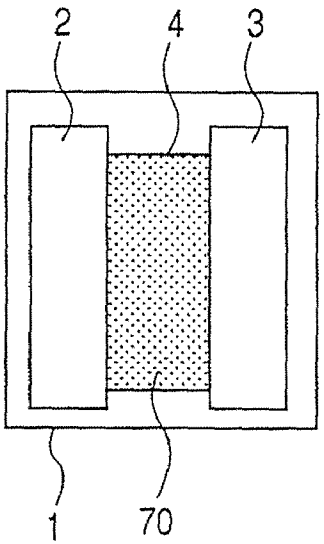
FIG. 5A, FIG. 5B, FIG. 5C and FIG. 5D schematically show electroconductive film corresponding with changes in the containing ratio of configuring material of electroconductive film.

The mode in FIG. 5A is a case with the percentage of the first particle 71 (area occupancy of the first particle 71) contained in the electroconductive film 4 being 0%. That is, in this case, the electroconductive film 4 in its entirety will be configured only by the second particles 70. Therefore, the resistance value between the first auxiliary electrode 2 and the second auxiliary electrode 3 will become lower compared with the case containing the first particles 71. And, the resistance of the electroconductive film 4 does not change substantially anywhere, and therefore qualitatively no specific region where electric fields are concentrated (currents are concentrated specifically) is generated.

Figure 5B:
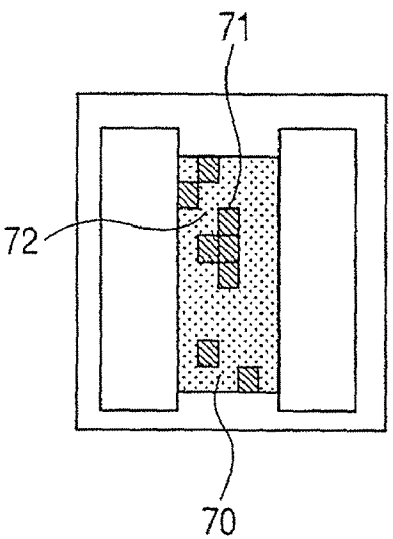

The mode in FIG. 5B is a case where the second particles 70 and the first particles 71 are present in the electroconductive film 4. That is, the second particles 70 and the first particles 71 are present nonhomogeneously in the electroconductive film 4. Compared with the case in FIG. 5A, the resistance between the first auxiliary electrode 2 and the second auxiliary electrode 3 will become larger. In addition, when the electroconductive film 4 of that mode undergoes an "energization forming" operation, the path of the current flowing between the first auxiliary electrode 2 and the second auxiliary electrode 3 is limited locally and therefore a region 72 where electric fields are concentrated locally is generated in a portion of the electroconductive film 4.

Figure 5C:
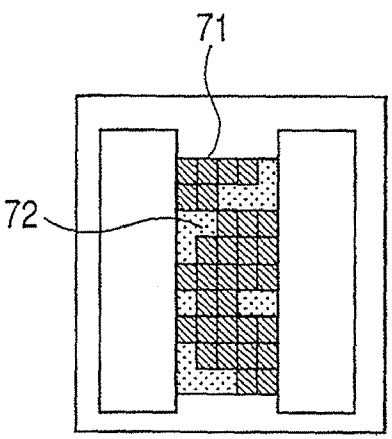

The mode in FIG. 5C is a case where the percentage of the first particles 71 contained in the electroconductive film 4 is made more abundant compared with the mode of FIG. 5B. In this case, the resistance value itself between the first auxiliary electrode 2 and the second auxiliary electrode 3 will become larger than the case of FIG. 5B. In addition, the electroconductive film 4 of this mode undergoes an "energization forming" operation, and then the current path is limited likewise in the case of FIG. 5B and the region 72 where the electric fields are locally concentrated is generated.

Figure 5D:
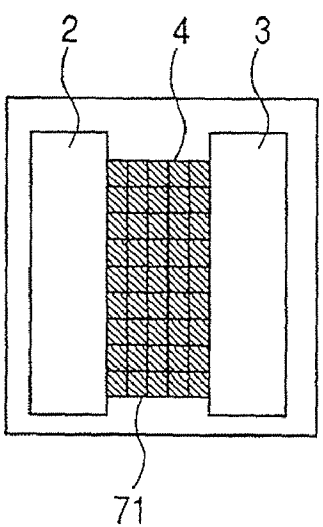

The mode in FIG. 5D is a case with the percentage of the first particle 71 contained in the electroconductive film 4 being 100%. That is, in this case, the electroconductive film 4 in its entirety will be configured only by the first particles 71. Therefore, the resistance value between the first auxiliary electrode 2 and the second auxiliary electrode 3 will become higher than any mode in FIG. 5A to FIG. 5C. And, in this case, likewise in the case of FIG. 5A, no specific region where electric fields are concentrated locally is generated at the time of the "energization forming" operation.

That is, likewise in FIG. 5B and FIG. 5C, if the electroconductive film 4 configured by mixing the first particles 71 and the second particle 70 nonhomogeneously is provided, the regions 72 where electric fields are concentrated at the time of the "energization forming" operation can be provided in advance. Consequently, the first gap 7 can be formed with good reproducibility and with low electric energy. Even if the "energization forming" operation is carried out on the electroconductive film 4 of the modes in FIG. 5A and FIG. 5D, the gap 7 will be formed substantially without utilizing concentration of electric fields. Consequently, the electroconductive film 4 of the modes in FIG. 5A and FIG. 5D will require much larger electric power compared with electric power required for the "energization forming" operation of the present invention. Accordingly, in order to carry out "energization forming" operation with low electric power on the electroconductive film 4 of the modes in FIG. 5A and FIG. 5D, conventionally, the electroconductive film 4 has to be formed by metal oxide and undergo "energization forming" operation under a reducible gas containing atmosphere. Here, configuring the electroconductive film 4 with metal film requires enormous currents to be flown and hence large electric power.

Thus, using the electroconductive film 4 with the first particles 71 and the second particles 70, the electroconductive film 4 can be provided in advance with a region where electric field is concentrated at the time of the "energization forming" operation. However, in the case of producing an electron-emitting device, only with tiny gap 7 being formed in a portion of the electroconductive film 4, sufficient electron-emitting properties are not obtainable. In order to obtain sufficient electron-emitting properties, it is important to form the gap 7 extended from one end to the other end of the electroconductive film 4 in the width (W') direction (a direction substantially perpendicular to the direction in which the auxiliary electrode 2 faces the auxiliary electrode 3) of the electroconductive film 4. In order to form the gap 7 which makes such sufficient electron-emitting properties obtainable, it is necessary to generate a large number of regions 72 where electric fields are concentrated at the time of "energization forming". The gap 7 which makes sufficient electron-emitting properties obtainable can be stated as described above to be a mode with practically the resistance value between the first electrode 4*a* and the second electrode 4*b* (the resistance value between the auxiliary electrode 2 and the auxiliary electrode 3) having increased by double digits or more larger than prior to "energization forming".

Therefore, the electroconductive film 4 which can generate a large number of electric field concentration portions (current concentration portions) at the time of "energization forming" will be described with FIG. 6A to FIG. 6C.

Figure 6A:
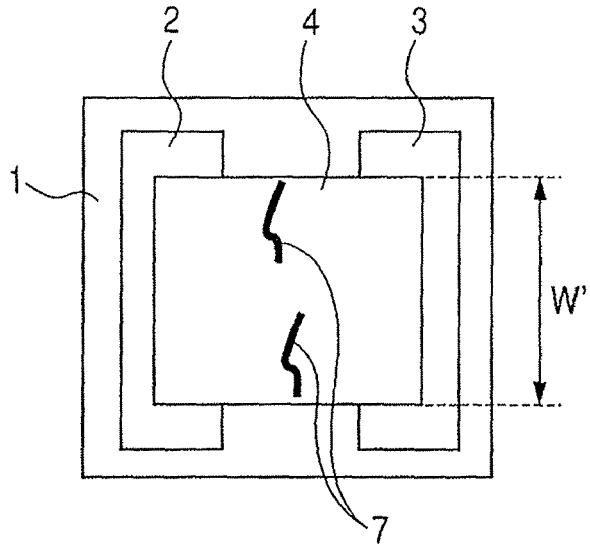
FIG. 6A, FIG. 6B and FIG. 6C schematically depict appearance of gaps formed corresponding with changes in the containing ratio of configuring material of electroconductive film.
Figure 6B:
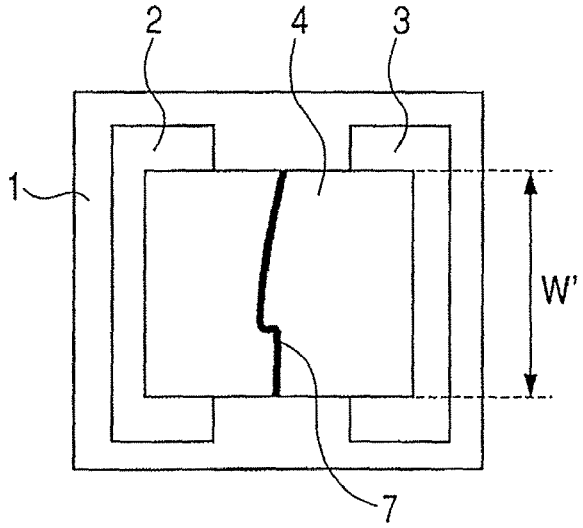
Figure 6C:
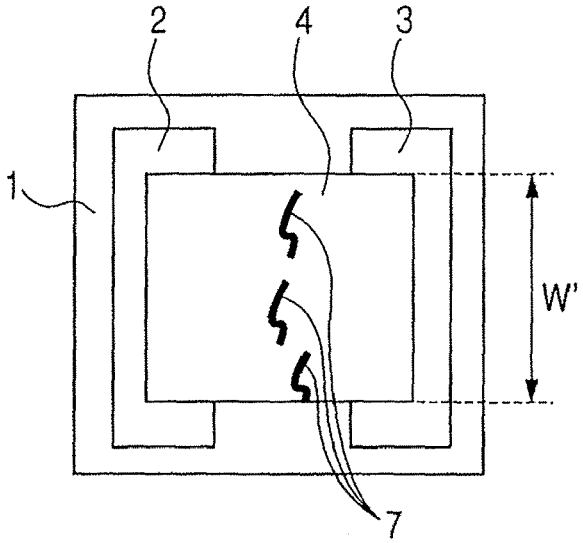

In FIG. 6A to FIG. 6C, the percentage of the first particle 71 in the electroconductive film 4 (area occupancy of the first region) is fixed to 30% (70% for the percentage of the second particle 70 (the area occupancy of the second region)). And schematically shown is the morphological difference of the gap 7 formed in the "energization forming" operation when the ratio of the first particle 71 to the second particle 72 is caused to change.

In the case where electric power inputted at the time of the "energization forming" operation (electric power inputted between the auxiliary electrode 2 and the auxiliary electrode 3) is made constant, the morphology of the gap 7 to be formed can be roughly classified into three types in FIG. 6A, FIG. 6B and FIG. 6C.

FIG. 6A shows a case where the resistance ratio (resistance of first particle 71)/(resistance of second particle 70)) is smaller than 5. That is, in this case, a plurality of gaps 7 are frequently formed mutually apart (intermittently). The gaps 7 will not be also formed across the entire region in the width (W') direction of the electroconductive film 4 but the first auxiliary electrode 2 and the second auxiliary electrode 3 frequently continues to retain substantially ohmic connection through the electroconductive film 4. A reason hereof is inferred that the resistance ratio between the first particle 71 and the second first particle 70 was small so that the number of electric field concentration region generated at the time of "energization forming" was not large or intensity of the generated electric field was little. In addition, in the case of this mode, a large electron-emitting amount is not obtainable even if the "activation" operation is carried out. In addition, at the time of electron emission, an ineffective current (device current If) flowing between the first auxiliary electrode 2 and the second auxiliary electrode 3 will become abundant.

FIG. 6B depicts a case where the resistance ratio is set to not less than 5 and not more than 1000. In this case, unlike the case shown in FIG. 6A, the electroconductive film 4 is substantially or completely split into two portions with one gap 7 in series. And, in this case, before and after the "energization forming" operation, the resistance value of the electroconductive film 4 has increased by not less than double digits. In addition, in this case, by carrying out the "activation" operation, a large electron-emitting amount has been obtainable. And, in this case, an ineffective current generated at the time of electron emission can be made less compared with the case in FIG. 6A, and consequently, high electron-emitting efficiency (electron-emitting current/device current) is obtainable.

FIG. 6C depicts a case where the resistance ratio is made larger than 1000. With this case, the gap 7 will not be formed across the entire region in the width (W') direction of the electroconductive film 4 likewise the case shown in FIG. 6A. A reason hereof is inferred that electric field concentration region generated at the time of "energization forming" was not large or intensity of the generated electric field was little likewise in the case of FIG. 6A.

Thus, in the case of setting the percentage of the first particle 71 contained in the electroconductive film 4 to 30% (percentage of the second particle 70 to 70%), the resistance ratio is set to not less than 5 and not more than 1000. Such setting makes it possible to form the gap 7 substantially across the entire region in the width (W') direction of the electroconductive film 4. In addition, before and after the "energization forming" operation, the resistance value of the electroconductive film 4 can be increased by not less than double digits.

Next, and the example shown in FIG. 6A to FIG. 6C is an example in which the percentage of the first particle 71 contained in the electroconductive film 4 has been set to 30%. Therefore, a table in FIG. 7 shows the gap 7 formed in the case of causing the percentage of the first particle 71 (area occupancy of the first region) contained in the electroconductive film 4 to change in addition to causing the resistance ratio to change. In the table in FIG. 7, the horizontal row is for percentage of the first particle 71 (area occupancy of the first region) contained in the electroconductive film 4 and the vertical column is for resistance ratio. Here, the table shown in FIG. 7 describes such a case where a voltage applied to the electroconductive film 4 (a voltage applied between the first auxiliary electrode 2 and the second auxiliary electrode 3) is same at the time of "energization forming" in each case.

Here, control of the particle resistance will not be limited to material to be used and control of composition, but also can be carried out, for example, by controlling the oxidization level of the first particles. In addition, the control also can be realized by configuring the first particle or the second particle respectively with the same two kinds of elements to change the containing ratio (composition ratio) of the two kinds of elements.

The symbol ○ in the table in FIG. 7 identifies the case where one continuous gap 7 is formed with the "energization forming" operation likewise in the case described for FIG. 6B. That is, there shown is a case where the gap 7 has been formed with the "energization forming" operation and, before and after the "energization forming" operation, the resistance value of the electroconductive film 4 has been successfully increased by not less than double digits.

On the other hand, the symbol x in the table in FIG. 7 identifies the case where good gap 7 has not been formed likewise the cases described for FIG. 6A and FIG. 6C.

Based on the table in FIG. 7, it is obvious that, adopting any of the following setting (1) to setting (3), the gap electrically splitting (electrically dividing) the electroconductive film 4 sufficiently can be formed with good reproducibility. In other words, adopting any of the setting (1) to setting (3), the gap 7 is formed with the "energization forming" operation and the resistance value of the electroconductive film 4 after the "energization forming" operation can be increased by not less than double digits than before the "energization forming" operation. Consequently, good gap 7 can be formable and good electron-emitting properties are obtainable.

(1): The resistance ratio is set to not less than 5 and not more than 1000 and the percentage of the first particle contained in the electroconductive film is set to not less than 2% (equal to or more than 2%) and not more than 30% (equal to or less than 30%).

(2): The resistance ratio is set to not less than 5 and not more than 800 and the percentage of the first particle contained in the electroconductive film is set to not less than 2% and not more than 40%.

(3): The resistance ratio is set to not less than 5 and not more than 400 and the percentage of the first particle contained in the electroconductive film is set to not less than 2% and not more than 60%.

Using the electroconductive film 4 satisfying any of the above described conditions (1) to (3), a good gap 7 is obtainable with small electric power equivalent to the case in use of reducible gas without using reducible gas which was conventionally required at the time of "energization forming" of electroconductive film made of metal oxide.

In other words, for the electroconductive film 4 of the present invention, (A) the resistance ratio is set to not less than 5 and not more than 1000 for the percentage of the first particle contained in the electroconductive film falling within the range of not less than 2% and not more than 30%; (B) the resistance ratio is set to not less than 5 and not more than 800 for the percentage of the first particle contained in the electroconductive film falling within the range of larger than 30% and not more than 40%; (c) the resistance ratio is set to not less than 5 and not more than 400 for the percentage of the first particle contained in the electroconductive film falling within the range of larger than 40% and not more than 60%.

Such settings make basically unnecessary to control the reducible state (change in resistance) of the electroconductive film 4 in the "energization forming" operation. Moreover, such settings can make the electric power required for the "energization forming" reduced and can simplify the fabrication apparatus. In addition, at the same time, time required for the "energization forming" operation can be shortened.

In addition, setting the resistance ratio of the above described first particle to the resistance of the second particle to not less than 50 and not more than 400, good electron-emitting properties are obtainable even in the case of allowing the standard deviation of the above-described particle size up to 33.3%. In addition, at that time, practically the ratio of the above described first particle is preferably set to fall within the range of not less than 2% and not more than 50%. Moreover, the average particle size of the first particle and the second particle are preferably set in particular to fall within the range of not less than 5 nm and not more than 20 nm.

Here, the electroconductive film 4 used for the present invention will not be limited to those configured only by two kinds of particles being different in resistance. That is, the present invention is applicable also to the case where electroconductive film 4 is configured by three or more kinds of particles being mutually different in resistance. In that case, practically, by selecting a combination of two kinds of particles with the total containing ratio reaching not less than 70% of the electroconductive film 4 so that the relationship described above between a resistance and a containing ratio is satisfied between the relevant two kinds of particles, effects of the present invention can be given rise to.

Using the electroconductive film 4 of the present invention fulfilling the above described conditions, the resistance value between the first electrode 4*a* and the second electrode 4*b* after the "energization forming" operation can be increased by not less than double digits than before the "energization forming" operation. Moreover, dispersion in shape of the gap 7 can be made less. In addition, after "energization forming" operation, the ineffective current flowing between the first electrode 4*a* and the second electrode 4*b* can be made less.

Accordingly, in the case where a large number of sheets of electroconductive film (electroconductive film after the "energization forming" operation) are connected commonly to wiring and an "activation" operation to be described below is concurrently carried out on a number of the sheets of electroconductive film, the ineffective current flowing in wiring can be reduced. Therefore, a voltage drop in wiring at the time of the "activation" operation can be made low. Therefore, "activation" operation intensive in uniformity can be carried out simply and conveniently through a common wiring on the respective sheets of electroconductive film (electron-emitting devices).

Subsequent to the above described (the process 2), preferably the "activation" operation is carried out as (the process 3). Depending, however, on morphology of the first gap 7, width of the gap 7 (distance between the first electrode 4*a* and the second electrode 4*b*), the material of the electroconductive film 4, when the "activation" operation can improve the electron emission current (Ie) and electron-emitting efficiency (Ie/If). Here, in the case where width of the gap 7 formed in the process 2 is not less than 1 nm and not more than 10 nm and stable electron-emitting properties can be maintained for a long period at the time of a drive (at the time of electron emission), "activation" does not necessarily have to be carried out. For example, if width of the gap 7 formed with the "energization forming" operation is formed typically to fall within the range of not less than 1 nm and not more than 10 nm (preferably not less than 3 nm and not more than 10 nm), the "activation" operation occasionally does not have to be carried out.

By carrying out the "activation" operation, the electroconductive carbon film (21*a* and 21*b*) can be disposed on the surface of the substrate 1 located inside the first gap 7 formed in "energization forming" and on the electrodes (4*a* and 4*b*) in the vicinity thereof (see (FIG. 1C and FIG. 2C)). Consequently, a second gap 8 is formed inside the first gap 7. The second gap 8 corresponds to the gap between the first carbon film 21*a* and the second carbon film 21*b*. Width of the second gap 8 (distance between the first carbon film 21*a* and the second carbon film 21*b*) is typically set to fall within the range of not less than 1 nm and not more than 10 nm (preferably not less than 3 nm and not more than 10 nm). With not less than 3 nm, stable electron emission can be maintained for a long period even if the voltage of less than 30 V is applied to the second gap 8. In excess of 10 nm, a voltage required at the time of a drive (a voltage required for causing electron emission) will increase while a driving circuit to be used will cost high.

The "activation" operation can be carried out by repeatedly applying voltage pulse between the first electrode 4*a* and the second electrode 4*b* (between the auxiliary electrode 2 and the auxiliary electrode 3) under carbon-containing gas (for example, organic gas) containing atmosphere. Here, the voltage pulse is preferably applied in a repeated fashion with the relationship of potential between the first electrode 4*a* and the second electrode 4*b* (the relationship of potential between the auxiliary electrode 2 and the auxiliary electrode 3) to be inverted periodically. Applying the voltage pulse with the relationship of potential between the first electrode 4*a* and the second electrode 4*b* (the relationship of potential between the auxiliary electrode 2 and the auxiliary electrode 3) to be inverted periodically, carbon film can be deposited efficiently on the both of the first electrode 4*a* side and the second electrode 4*b* side.

Organic substance is nominated as a typical example of the above described carbon-containing gas. There nominated is organic substance selected from the group consisting of, for example, alkane, alkene, aliphatic hydrocarbons of alkyne, aromatic hydrocarbons, alcohols, aldehydes, ketones, amines, phenol, carvone, organic acids such as sulfone acid and the like. In addition, more specifically, there usable is saturated hydrocarbon expressed as $C_nH_{2n+2}$ selected from the group consisting of methane, ethane, propane and the like and unsaturated hydrocarbon expressed as composition formula such as $C_nH_{2n}$ selected from the group consisting of ethylene, propylene and the like. In addition, there usable is substance selected from the group consisting of benzene, toluene, methanol, ethanol, formaldehyde, acetaldehyde, acetone, methylethylketone, methylamine, ethylamine, phenol, aminoformic acid, acetic acid, propionic acid and the like.

"Activation" operation can form a film (carbon film 21*a* and 21*b*) made of carbon or a carbon compound with organic substance present in the atmosphere. Consequently, in general, the emission current Ie can be remarkably improved.

Carbon or a carbon compound is selected from the group consisting of, for example, graphite (including so-called HOPG, PG and GC) and amorphous carbon (amorphous carbon or a mixture of amorphous carbon and fine crystal of the above described graphite). Here, HOPG denotes an almost complete graphite crystal structure; PG denotes graphite crystal structure comprising particles of around 20 nm with a slightly disorganized crystal structure; and GC denotes graphite crystal structure comprising particles of around 2 nm with further disorganized crystal structure.

For maintaining good electron-emitting properties for a long period, film thickness of the carbon film (21*a* and 21*b*) is preferably set to fall within the range of not less than 10 nm and not more than 100 nm.

"Activation" makes it possible, for example, to measure device current (If) flowing between the first electrode 4*a* and the second electrode 4*b* (between the first auxiliary electrode 2 and the second auxiliary electrode 3) and to finish the measurement at the point of time when the device current value has reached a desired value. Here, pulse width, a pulse interval, a pulse crest value and the like of voltage pulse used in the "activation" operation is set to desired values appropriately.

The electroconductive carbon film (21*a* and 21*b*) deposited with that "activation" operation makes it possible to narrow width of the first gap 7 effectively and, consequently, to decrease the drive voltage required for electron emission and to improve electron-emitting efficiency (Ie/If).

In addition, subsequent to the above described (the process 3), preferably as (the process 4), the substrate 1 having the carbon film (21*a* and 21*b*) formed thereon undergoes a baking operation. That process causes an electron-emitting device formed by carrying out the above described "activation" operation to undergo heating processing in an atmosphere maintained to pressure lower than the atmosphere (decompressed atmosphere) and thereby removes extra impurities attached to the surface of the substrate 1 and the surface of the electron-emitting device.

The partial pressure of organic components in the atmosphere with pressure lower than the atmosphere at the time of baking processing is partial pressure under which approximately no more carbon or the carbon compound is deposited additionally. Typically, the partial pressure of carbon or the carbon compound is set to not more than $10^{-6}$ Pa and preferably not more than $10^{-8}$ Pa.

In addition, the baking condition is set to fall within the range of 80° C. to 250° C. and preferably not less than 150° C. It is necessary to lower the pressure inside a vacuum container as much as possible, preferably to not more than $10^{-5}$ Pa and more preferably to not more than $10^{-6}$ Pa in particular.

The atmosphere at the time of driving the electron-emitting device of the present invention formed through the process as described above preferably maintains the state of the atmosphere at the time when the above described basing operation finishes but will not be limited hereto. For example, if organic substance is removed sufficiently, sufficiently stable properties can be maintained even if the vacuum level itself increases more or less. Adoption of such a vacuum atmosphere can restrain deposition of additional carbon or a carbon compound, can remove $H_2O$, $O_2$ and the like stuck onto the vacuum container or the substrate and the like and consequently, stabilizes the device current If and the emission current Ie.

In addition, it is preferable to verify the resistance ratio of the first particle to the second particle configuring the above described electroconductive film 4 of the present invention and the containing ratio of the first particle included in the electroconductive film 4 based on the electroconductive film 4 prior to the above described "energization forming" process. However, for example, a portion being a part of the electroconductive film 4 and located on the auxiliary electrodes (2 and 3) is hardly susceptible to influence of the process of fabricating an electron-emitting device or an image display apparatus compared with the vicinity of the gap 7. Accordingly, on an occasion of analyzing the above described resistance ratio and the containing ratio and the composition ratio of the first particle in the electroconductive film 4, the above described portion is analyzed, for example, and thereby the state of the electroconductive film 4 prior to "energization forming" can be measured effectively.

As a method of measuring the containing ratio of first particle ("area occupancy") in the electroconductive film 4 examples can include a method selected from the group consisting of, for example, FE-AES (Field Emission Auger Electron Spectrometry), ESCA (Electron Spectroscopy for Chemical Analysis) and XPS (X-ray Photoelectron Spectroscopy). That is, by carrying out two-dimensional surface analysis on the surface of the electroconductive film 4, the composition can be measured. The ESCA and the XPS can carry out measurement by mapping the state of the chemical bond on a unit area basis on the surface of the electroconductive film 4 (typically can be defined as a right square region with size of 1 μm×1 μm).

In the case where the electroconductive film 4 is configured by a large number of particles, it is also possible to employ a field emission Auger electron spectrometer (FE-AES) to analyze the composition of respective particles. The film thickness of the electroconductive film 4 has an extremely small value compared with distance between the auxiliary electrode 2 and the auxiliary electrode 3 and width thereof. Therefore, only measurement on the surface state of the electroconductive film 4 will do. The containing ratio (area ratio) of the first particle (first region) and the second particle (second region) and the area occupancy of the first particle (first region) and/or the second particle (second region) can be calculated effectively with the above described methods from upward the electroconductive film 4. Here, the electroconductive film usable for the present invention will not exclude those in a morphology with a plurality of (typically two) particles being stacked in the direction of film thickness thereof in a part thereof.

In addition, measurement on resistance of the above described first particle and/or second particle can be carried out with various measuring methods, such as by cutting out a part of the electroconductive film located on the auxiliary electrodes (2 and 3).

In addition, analyzing the particle composition with the above described FE-AES, resistance of the relevant analyzed particle can be measured by causing a probe of AFM to contact a particle, utilizing a contact mode of an AFM (atom force microscope). In the case of this method, it is preferable to measure the electroconductive film (particle) located on the auxiliary electrodes (2 and 3) in particular. According to this method, it is possible to measure resistance of a particle based on the current flowing between the probe of the AFM and the auxiliary electrode.

Basic properties of the electron-emitting device of the present invention obtained through the process described above will be described with reference to FIG. 8 and FIG. 9. Here, the electron-emitting device having undergone the above described "activation" operation will be described. In addition, in order to simplify the description, the auxiliary electrodes (2 and 3) have been omitted from the drawings.

Figure 8:
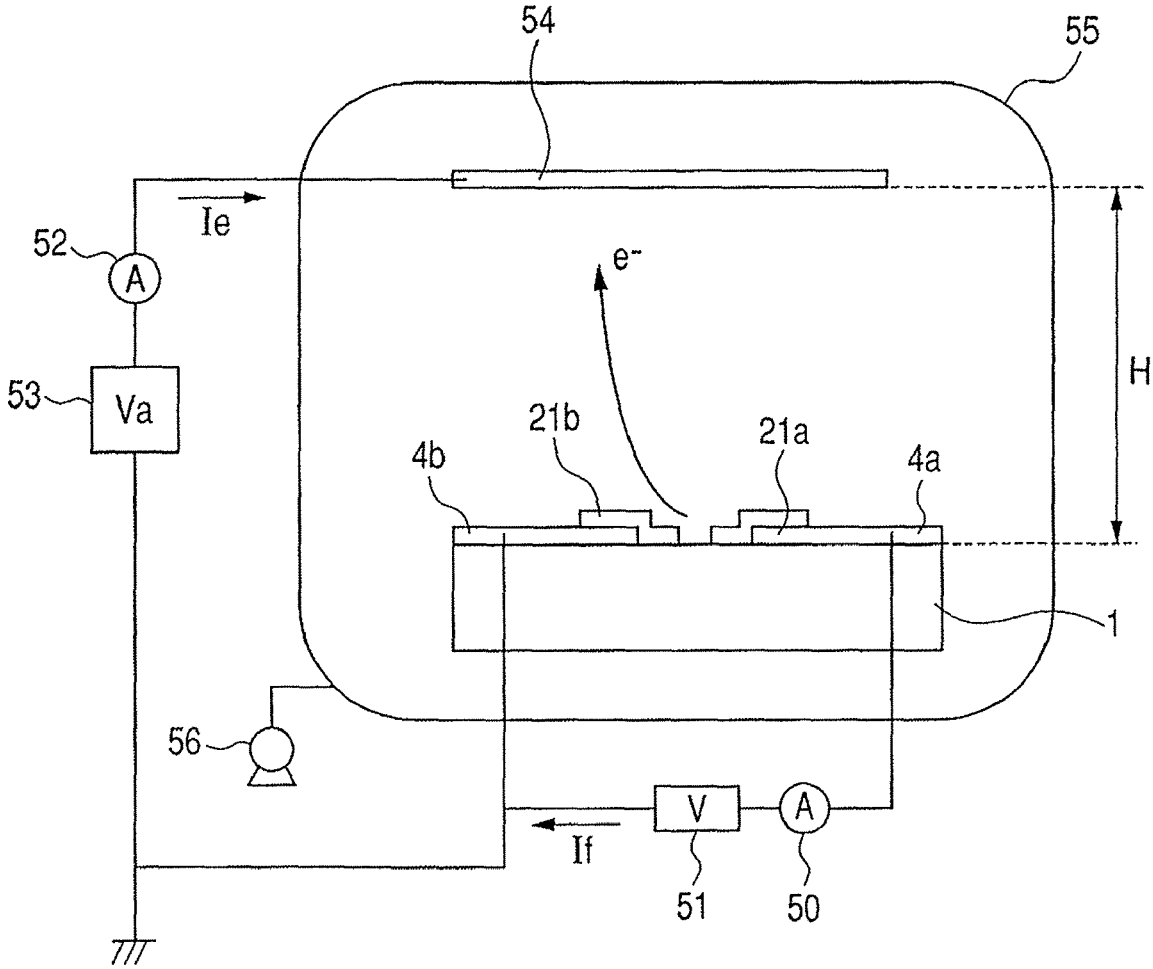
FIG. 8 schematically shows a configuration of an apparatus for measuring electron-emitting properties.

FIG. 8 schematically shows an example of a vacuum operation apparatus and this vacuum operation apparatus also comprises a function as a measurement assessment apparatus. Also for the particles in FIG. 8, same reference characters designate the same particles shown in FIG. 1A to FIG. 1C.

In FIG. 8, reference numeral 55 denotes a vacuum container and reference numeral 56 denotes an exhaust pump. Inside the vacuum container 55, an electron-emitting device is disposed. Reference numeral 51 denotes a power supply for applying a device voltage Vf between the first electrode 4*a* and the second electrode 4*b* (between the first auxiliary electrode 2 and the auxiliary electrode 3). Reference numeral 50 denotes an ammeter for measuring a device current If flowing between the first electrode 4*a* and the second electrode 4*b* (between the first auxiliary electrode 2 and the second auxiliary electrode 3). Reference numeral 54 denotes an anode electrode for capturing the emission current Ie emitted from the electron-emitting device. Reference numeral 53 denotes a high-voltage power supply for applying a voltage to the anode electrode 54. Reference numeral 52 denotes an ammeter for measuring the emission current Ie emitted from the electron-emitting device. The voltage of the anode electrode 54 is 1 kV to 100 kV and can be measured, setting distance H between the anode electrode and the electron-emitting device to fall within the range of 1 to 8 mm. Appliances required for measurement under a vacuum atmosphere such as a vacuum gauge and the like not shown in the drawing is provided inside the vacuum container 55 so that measurement and assessment under a desired vacuum atmosphere can be carried out.

The exhaust pump 56 can be configured by an ordinal high vacuum apparatus system comprising a turbo pump, a rotary pump and the like and an ultra high vacuum apparatus system comprising an ion pump and the like. The vacuum apparatus shown here can be heated by a heater not shown in the drawing. Accordingly, with this vacuum apparatus, the process of the above described "energization forming" and onward can be carried out.

FIG. 9 schematically shows the relationship between the emission current Ie as well as the device current If and the device voltage Vf which have been measured with the vacuum apparatus shown in FIG. 8. In FIG. 9, the emission current Ie is remarkably small compared with the device current If and therefore is indicated on an optionally selected unit. Here, the both vertical and horizontal axes are scaled linearly. In the case where the gap 7 was successfully formed to satisfy the conditions such as width described above with the "energization forming" operation, the properties shown in FIG. 9 similar to post-"activation" operation properties even if no "activation" operation is carried out can be obtained.

As apparent from FIG. 9, the electron-emitting device of the present invention has following three characteristic natures on the emission current Ie.

That is, firstly, by applying a device voltage of not less than a certain voltage (called threshold voltage; Vth in FIG. 9), the emission current Ie increases rapidly and on the other hand, at not more than the threshold voltage Vth, almost no emission current Ie is detected. That is, it is non-linear device having a distinct threshold voltage Vth for the emission current Ie.

Secondly, since the emission current Ie depends on the device voltage Vf in a monotonically increasing fashion, the former can be controlled by the latter.

Thirdly, the emission charges captured by the anode electrode 54 (see FIG. 8) depend on time when the device voltage Vf is applied. That is, the charge amount captured by the anode electrode 54 can be controlled by the time when the device voltage Vf is applied.

As taken from the above described description, the electron-emitting device of the present invention will become capable of easily controlling electron-emitting properties in accordance with input signals. Utilizing this nature, application to various fields will become feasible as in the case of an electron source, image forming apparatus and the like configured by a plurality of electron-emitting devices being arranged.

Next, an example of application of the electron-emitting device of the present invention will be described below. Arranging a plurality of electron-emitting devices of the present invention on a substrate, an electron source and an image display apparatus, for example, can be configured.

Various kinds of arrangements can be adopted for the electron-emitting devices. As an example, the first electroconductive film 4*a* and the second electroconductive film 4*b* are respectively connected commonly to the first wiring and the second wiring so that a number of electron-emitting devices arranged in one direction (the direction of a row) are connected in parallel. And a large number of thus configured rows of electron-emitting devices are arranged on the same substrate. And a control electrode (also called as a grid) is disposed so as to be located in the direction (the direction of the column) perpendicular to the first and the second wiring extending in the same direction (the direction of the row) and above the respective electron-emitting devices. Taking such a configuration, electrons emitted from the respective electron-emitting devices can be controlled.

On the other hand, there is a case where a plurality of electron-emitting devices are arranged in the X direction and the Y direction in a matrix state, the first electroconductive film 4*a* of a plurality of electron-emitting devices arranged on the same row being commonly connected to the wiring in the X direction and the second electroconductive film 4*b* of a plurality of electron-emitting devices arranged on the same column being commonly connected to the wiring in the Y direction. Such a mode is a so-called "simple matrix" arrangement. The simple matrix arrangement will be described in detail below.

The electron-emitting device of the present invention has three properties as described above. That is, electrons emitted from the electron-emitting device can be controlled with the crest value and width of the pulse voltage applied between the first electroconductive film 4*a* and the second electroconductive film 4*b* beyond the threshold voltage. On the other hand, little emission will take place at the threshold or a lower voltage. According to this property, also in the case where a large number of electron-emitting devices are disposed, if a pulse-like voltage is appropriately applied to each electron-emitting device, an electron-emitting device can be selected in accordance with an input signal to control the electron emission amount.

Figure 10:
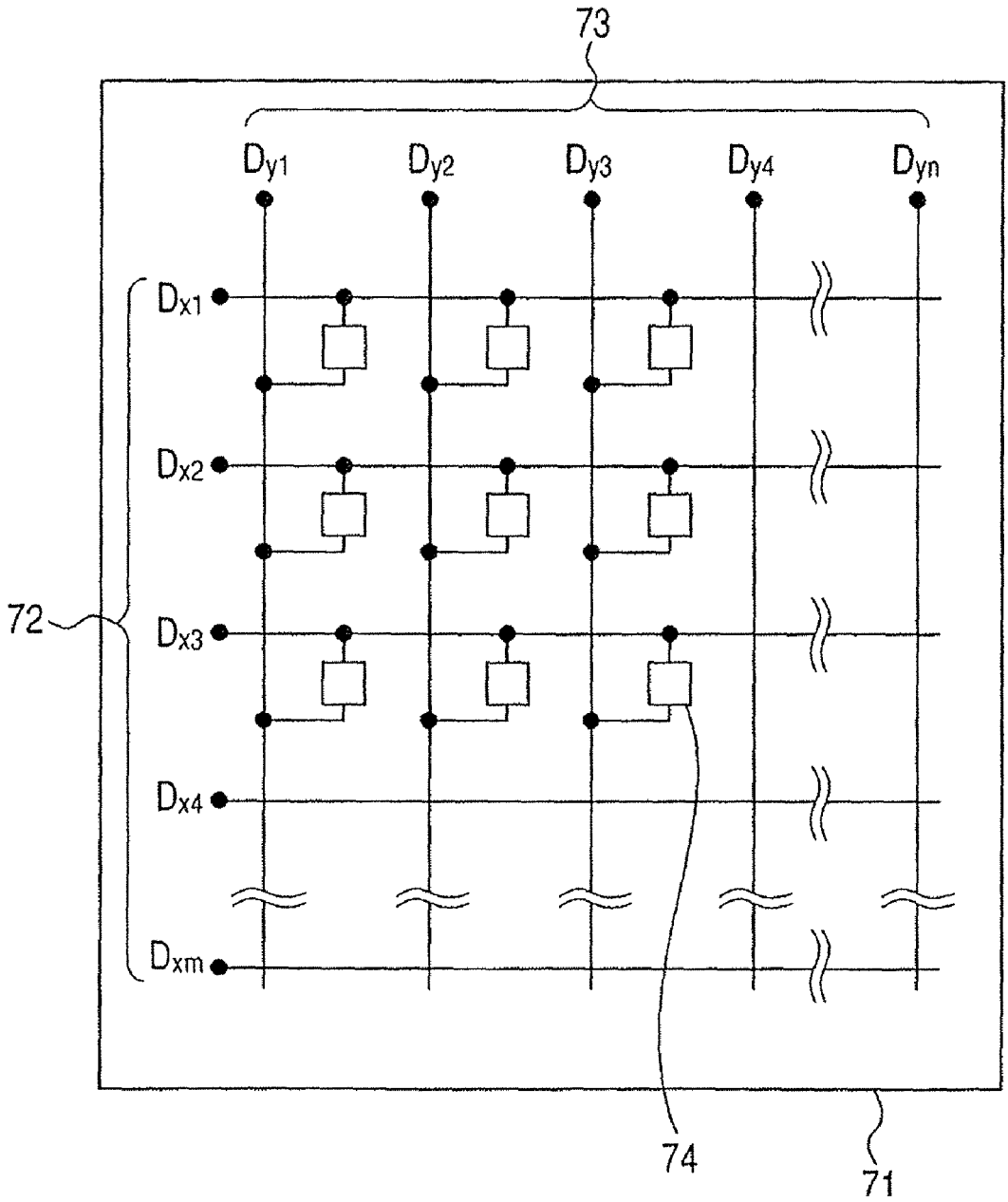
FIG. 10 shows schematically an example of a configuration of an electron source.

A substrate (rear plate) 71 comprising an electron source obtained by arranging the electron-emitting devices of the present invention in a "simple matrix" arrangement based on that principle will be described with FIG. 10. In FIG. 10, reference numeral 71 denotes a substrate (rear plate); reference numeral 72 denotes wiring in the X direction (Dx1 to Dxm); and reference numeral 73 denotes wiring in the Y direction (Dy1 to Dyn). Reference numeral 74 denotes an electron-emitting device of the present invention.

m units of X direction wiring 72 are configured by wiring Dx1, Dx2, through to Dxm and can be formed with a method selected from the group consisting of a vacuum evaporation method, a printing method, a sputtering method and the like. Material, film thickness and width of wiring are appropriately designed. n units of Y direction wiring 73 are configured by wiring Dy1, Dy2, through to Dyn and can be formed likewise the X direction wiring 72. An inter-layer insulating layer not shown in the drawing is provided between these m units of X direction wiring 72 and n units of Y direction wiring 73 to separate the both electrically (m and n are both positive integers).

The inter-layer insulating layer not shown in the drawing is configured by silicon oxide (typically $SiO_2$) and the like formed with a method selected from the group consisting of a vacuum evaporation method, a printing method, a sputtering method and the like. Film thickness, material and fabrication method of the inter-layer insulating layer are appropriately selected so as to be endurable to the potential difference of the intersection made by the X direction wiring 72 and the Y direction wiring 73. The X direction wiring 72 and the Y direction wiring 73 are pulled out from inside to outside of space of an image display apparatus and the like maintained at pressure lower than the atmosphere.

The first electroconductive film 4*a* (first auxiliary electrode 2) configuring each electron-emitting device 74 is electrically connected to any one of the m units of the X direction wiring 72 and the second electroconductive film 4*b* (second auxiliary electrode 3) is electrically connected to any one of the n units of the Y direction wiring 73.

Material configuring the wiring 72 and the wiring 73 and material configuring the first and the second electroconductive film (first and second auxiliary electrodes) may be the same in a part of the component element or in their entirely and may be different each other.

Here, an example of a method of fabricating a substrate (rear plate) comprising an electron source in such a "simple matrix" arrangement will be described below with FIG. 17.

Figure 17A:
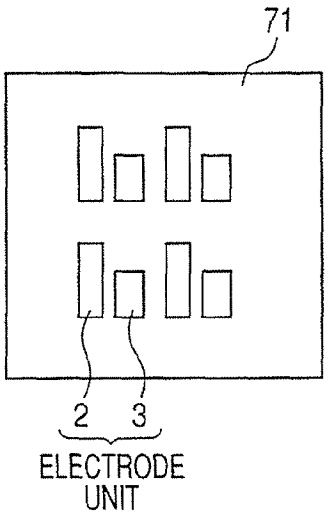
FIG. 17A, FIG. 17B, FIG. 17C, FIG. 17D, FIG. 17E and FIG. 17F show schematically an example of a method of fabricating of an electron source of the present invention.

Firstly, electrode unites (2 and 3) comprising the first auxiliary electrode 2 and the second auxiliary electrode 3 are provided on the substrate (rear plate) 71 in a matrix state in a desired number (for example, 1920 (column)×1080 (row)) (FIG. 17A).

Figure 17B:
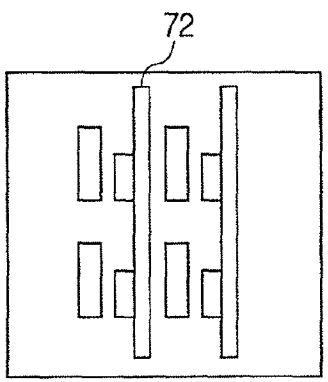

Next, the X direction wiring 72 bringing the auxiliary electrodes 3 into common connection in a vertical direction is provided in the same number (or more than the same number) as the number equivalent to the number of columns of the electrode unit (FIG. 17B).

Figure 17C:
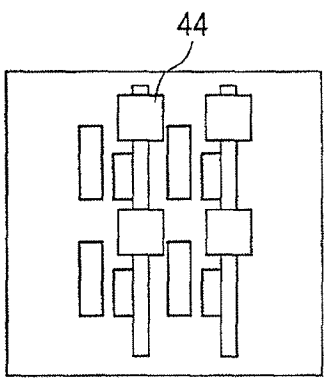

Subsequently, an insulating layer 44 is formed in each intersection where the Y direction wiring 73 and the X direction wiring 72 to be formed in the next process intersect (FIG. 17C).

Figure 17D:
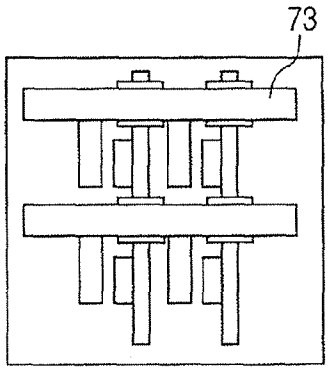

Next, the Y direction wiring 73 bringing the auxiliary electrodes 2 into common connection in a horizontal direction is provided in the same number (or more than the same number) as the number equivalent to the number of rows of the electrode unit (FIG. 17D).

Figure 17E:
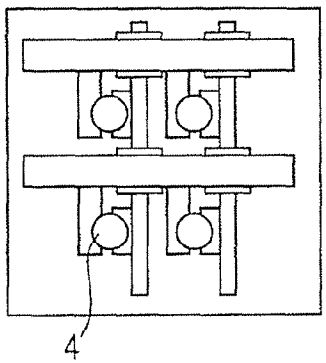

Next, the electroconductive film 4 of the above described present invention is formed in the same number as the number of the electrode units so that each film brings the first auxiliary electrode 2 and the second auxiliary electrode 3 of each electrode unit into connection (FIG. 17E).

Figure 17F:
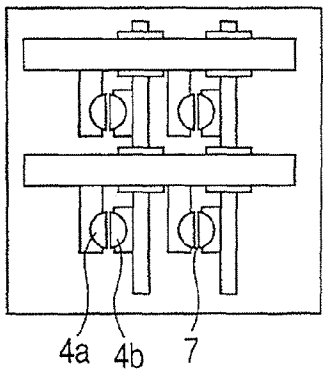

Subsequently, the gap 7 is provided in each electroconductive film 4 (FIG. 17F). The gap 7 is preferably formed substantially concurrently in all the units commonly connected to one Y direction wiring 73.

Figure 18:
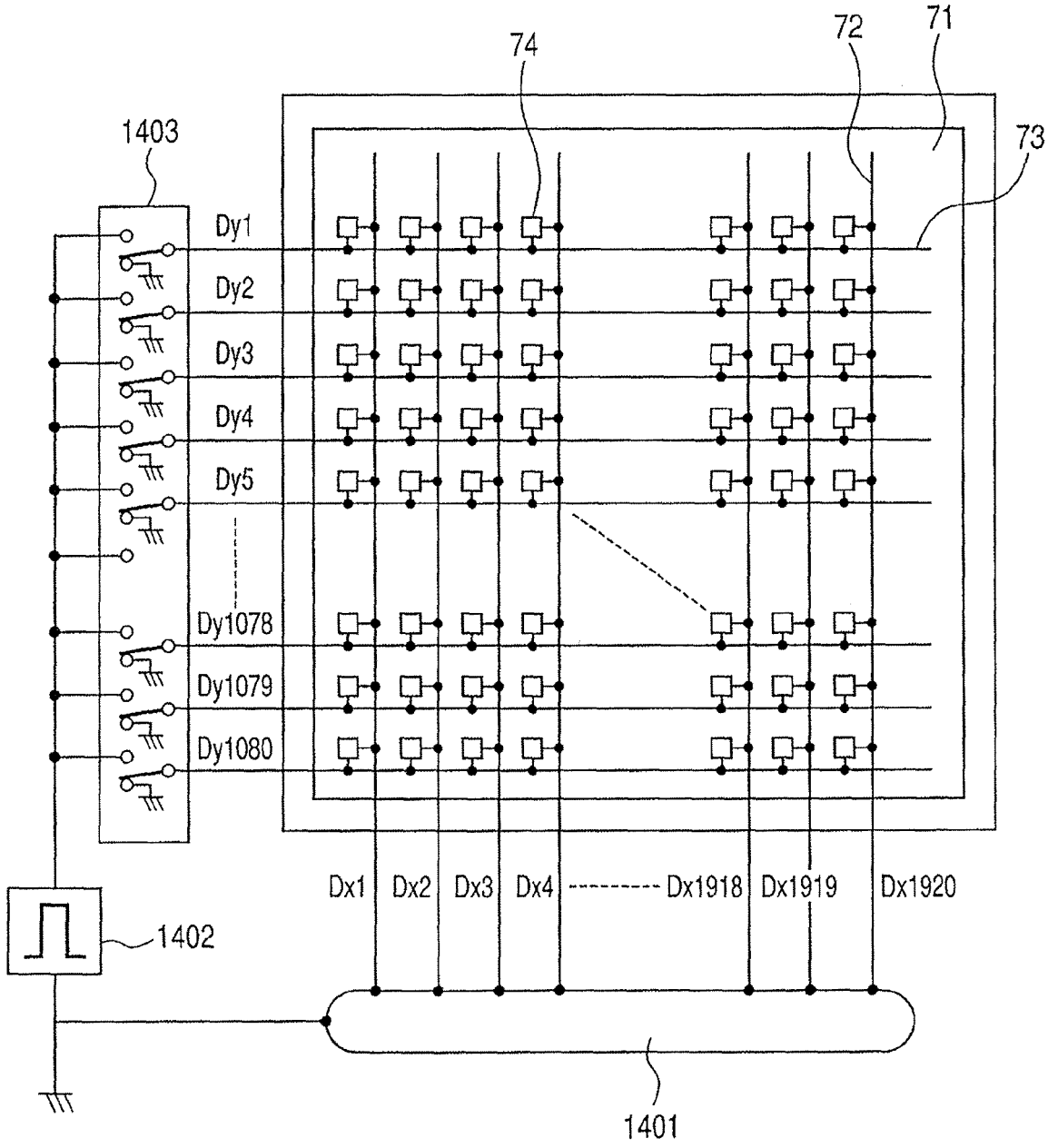
FIG. 18 shows schematically an example of an energization forming method of the electron source of the present invention.

A specific method will be described with FIG. 18 (here, for the particle in FIG. 18, same reference numerals as used in the other drawings designate the same particles). For example, all units of the X direction wiring 72 are selected with a switching circuit 1403 in synchronization with selection of one Y direction wiring among a large number of units of the Y direction wiring 73. As a technique of selecting all of the X direction wiring 72, for example, all of the X direction wiring is preferably connected to a common electrode 1401. And, voltage pulse as shown in FIG. 3 is applied with a pulse generating source 1402 between one Y direction wiring selected with the switching circuit 1403 and all of the X direction wiring 72 preferably to carry out the above described "energization forming" process. Thus, chronological discrepancy takes place more or less on all of the units (the electroconductive film 4 commonly connected to the selected Y direction wiring) commonly connected to the selected Y direction wiring 73 but the gap 7 can be formed substantially concurrently. And, switching the Y direction wiring of sequentially selecting such operations with the switching circuit 1403, the gap 7 can be formed to all the units.

Here, an example of carrying out the "energization forming" process on each one of the Y direction wiring has been shown, but if a plurality of units of Y direction wiring are selected concurrently, the "energization forming" operation also can be carried out substantially concurrently on the electroconductive film 4 commonly connected to a plurality of units of the Y direction wiring selected concurrently.

In addition, in the electroconductive film 4 of the present invention, the gap 7 can be formed ideally with application of one voltage pulse. Therefore, the pulse applied in the "energization forming" process is required ideally only for the number of units of the Y direction wiring (for example, the pulse is provided 1080 times for 1080 units of the Y direction wiring 73). However, depending on dispersion in resistance of wiring, resistance of an electrode unit, resistance of the electroconductive film 4 and the like, the gap 7 is not always formed with one application of voltage pulse. Accordingly, for "energization forming", voltage pulse applied to each unit of the Y direction wiring is preferably applied a plurality of times so that a good gap 7 is formed stably with good reproducibility.

In addition, in the case where the number of units of voltage pulse applied to each unit of the Y direction wiring is more than 1, voltage pulse is preferably applied to the unit commonly connected to the other Y direction wiring between the interval between the succession of units of voltage pulse (an interval between pulse and pulse). That is, in description with FIG. 18, for example, voltage pulse is applied sequentially from the Y direction wiring Dy2 to Dy1080 during the period starting the time when the Y direction wiring Dy1 is selected to apply voltage pulse until the Y direction wiring Dy1 is selected to apply voltage pulse subsequently. Thus, the period required for "energization forming" process can be shortened. In addition, selecting a plurality of units of the Y direction wiring, the period required for "energization forming" operation can be shortened further corresponding with that number of units. For example, dividing the Y direction wiring (Dy1 to Dy1080) by 10 units, 108 groups are set. And selecting one Y direction wiring from each of the 108 groups concurrently, voltage pulse is applied once. Subsequently, selecting another Y direction wiring from each of the 108 groups concurrently, voltage pulse is applied once. Repeating this procedure sequentially, substantially 10 units of the Y direction wiring can undergo the "energization forming" operation concurrently. Thus, the gap 7 can be formed on a large number of sheets of electroconductive film 4 short time.

And, scan signal applying means not shown in the drawing of applying a scan signal for selecting the row of the electron-emitting device 74 arranged in the X direction are connected to the X direction wiring 72 of the electron source of the above described "simple matrix" type. On the other hand, modulation signal generating means not shown in the drawing for modulating each column of the electron-emitting devices 74 arranged in the Y direction corresponding with an input signal are connected to the Y direction wiring 73. The drive voltage applied to each electron-emitting device is supplied as a balance voltage between the scan signal and the modulation signal.

Figure 11:
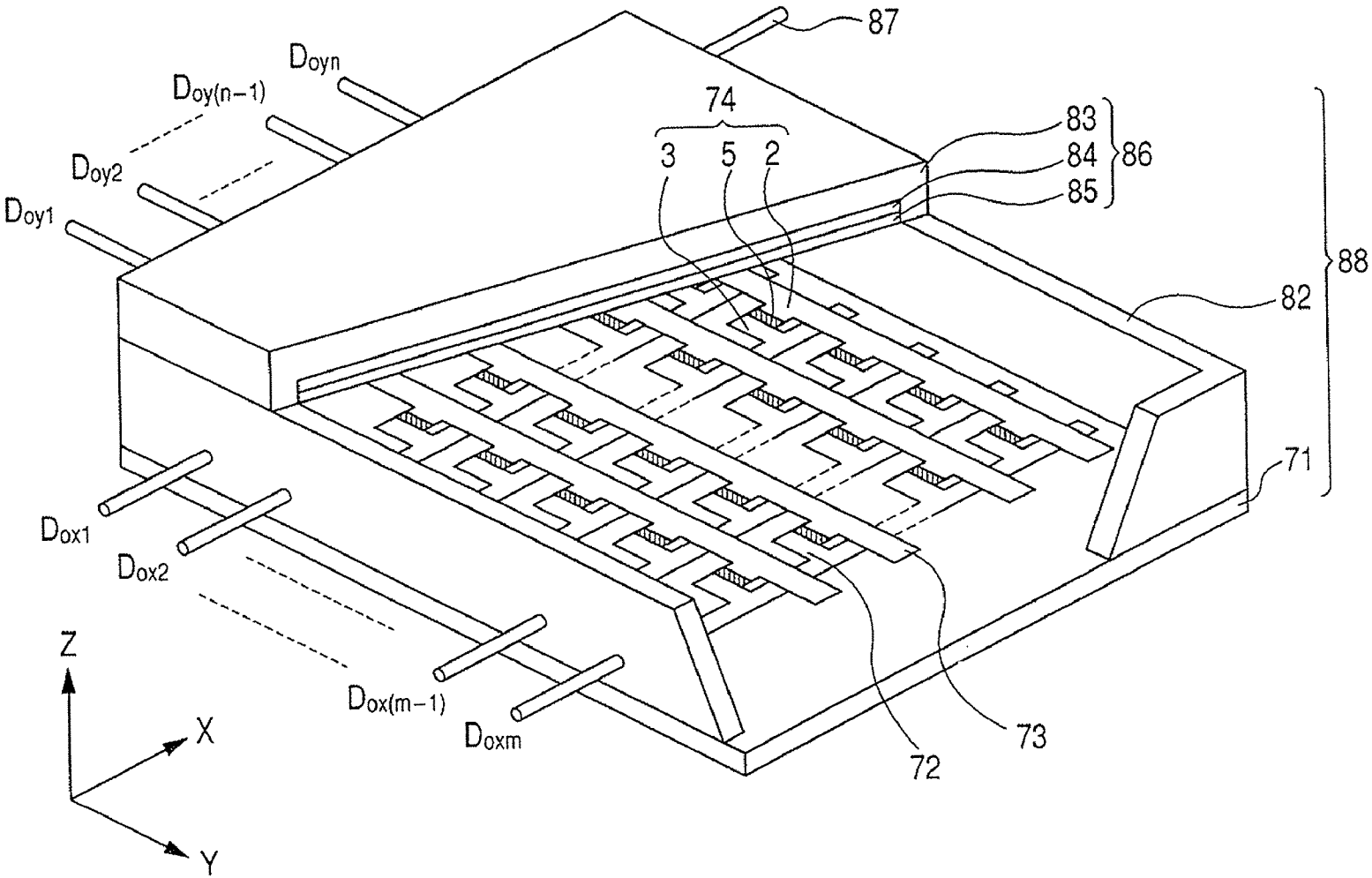
FIG. 11 is a schematic perspective view of an image display apparatus.
Figure 12A:
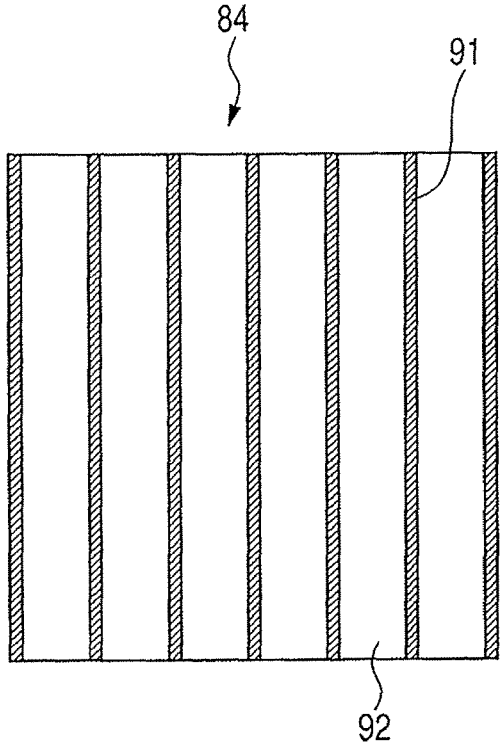
FIG. 12A and FIG. 12B show schematically an example of a configuration of a phosphor film.
Figure 12B:
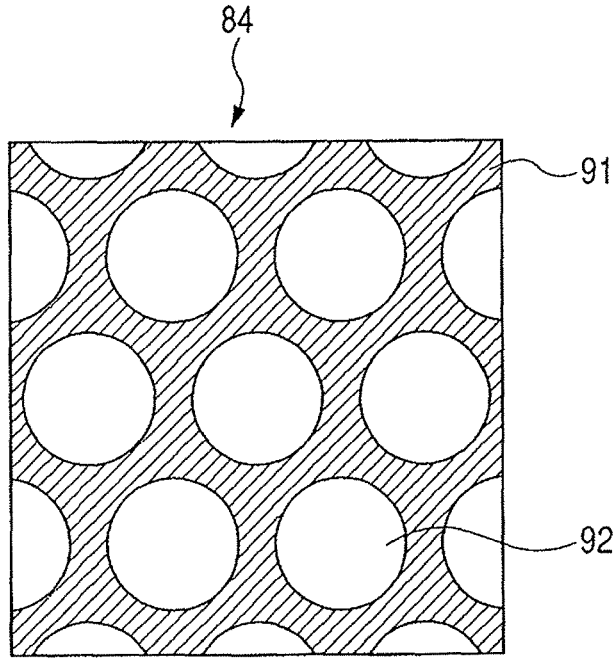

Next, an image display apparatus configured with such a matrix type electron source will be described with FIG. 11, FIG. 12A and FIG. 12B. FIG. 11 schematically shows an example of a display panel 88 of an image display apparatus; and FIG. 12A and FIG. 12B schematically show an example of a phosphor film 84 used in the display panel 88 in FIG. 11.

In FIG. 11, reference numeral 71 denotes a substrate (rear plate) provided with a plurality of electron-emitting devices 74; and reference numerals 72 and 73 denote X direction wiring and Y direction wiring connected to a pair of auxiliary electrodes (2, 3) of the electron-emitting device. Reference numeral 86 denotes a face plate comprising phosphor film 84, electroconductive film (metal back) 85 being an anode electrode and the like being formed on the interior surface of the glass substrate 83. Reference numeral 82 denotes a support frame and the rear plate 71 and the face plate 86 are connected to the support frame 82. Reference numeral 88 denotes a display panel and comprises the face plate 86, the support frame 82 and the rear plate 71.

Here, a support member called spacer not shown in the drawing can be installed between the face plate 86 and the rear plate 71 to configure the display panel 88 provided with sufficient strength against the atmosphere pressure.

FIG. 12 schematically shows an example of the phosphor film 84. The phosphor film 84 can be configured only by phosphor in a monochrome case. Color phosphor film can be configured by light absorption member (black member) 91 called black stripe (FIG. 17A) or black matrix (FIG. 17B) and the like and phosphor 92. An object of providing the light absorption member 91 is, in the case of color display, to make color mixture and the like little remarkable by blackening the border between phosphors 92 emitting different colored light and to restrain contrast due to reflection of outside light in phosphor film 84 from dropping. As material of the light absorption member 91, material being electroconductive, less transparent and less reflective can be used in addition to material containing graphite as a main component.

Normally, an anode electrode (electroconductive film) 85 is provided on the interior side of the phosphor film 84 (rear plate side). This anode electrode formed with metal film such as aluminum film and the like is called "metal back". An object of providing the metal back is to cause light directed to the interior side (rear plate side) in light emitted from the phosphor to be reflected to the side of the face plate 86 and thereby improve luminance of light emission of the display. In addition, the metal back is activated as an anode electrode for applying electron beam acceleration voltage, protects the phosphor against damage due to impact of negative ion generated inside the display panel 88 and the like. The metal back can be produced by carrying out smoothing operation (normally called "filming") of the surface of the interior side of the phosphor film after production of the phosphor film and thereafter depositing Al with vacuum evaporation and the like.

In order to enhance the electroconductive nature of the phosphor film 84 further, the face plate 86 may be provided with a transparent electrode (not shown in the drawing) on the exterior surface side (between the phosphor film 84 and the glass substrate 83) of the phosphor film 84.

Such a display panel 88 is preferably formed, for example, as described below. That is, a large number of electron-emitting devices are formed on the rear plate 71 in advance with the above described fabrication method of the present invention (a substrate comprising an electron source is provided). On the other hand, the phosphor film 84 and the metal back 85 are formed on the face plate 86 with the above described method and the like. And, the support frame 82 is disposed between the rear plate 71 and the face plate 86, and the junction portions made by the supporting 82 and the face plate as well as the rear plate are bonded and sealed with adhesive selected from the group consisting of indium, flit glass and the like. Here, if junction between the support frame 82 and the face plate as well as the rear plate is carried out under predetermined pressure lower than pressure of the atmosphere, the display panel 88 with space between the face plate and the rear plate retained at predetermined pressure is obtainable.

A voltage is applied to each electron-emitting device 74 inside the above described display panel 88 through terminals Dx1 to Dxm and Dy1 to Dyn so as to cause thereby the desired electron-emitting devices to emit electrons. At that time, a voltage of not less than 5 kV and not more than 30 kV and preferably not less than 10 kV and not more than 25 kV to the electroconductive film 85 through a high voltage terminal 87. Here, the distance between the face plate 86 and the substrate 71 is set to not less than 1 mm and not more than 5 mm and more preferably not less than 1 mm and not more than 3 mm. Thus, electrons emitted from the selected electron-emitting device penetrate the electroconductive film 85 to collide against the phosphor film 84. And thereafter the phosphor 92 is excited and caused to emit light to display an image.

Here, in the configuration described above, detailed portions such as material of respective particles and the like will not be limited to the contents described above but are appropriately modified corresponding with objects.

In addition, with the display panel 88 of the present invention described with FIG. 11, an image display/reproduction apparatus such as a television and the like, which display or reproduce information, can be configured.

Specifically, a receiver of receiving broadcast signals such as a television broadcast and a tuner for selecting the received signals cause at least one of video information, text information and audio information included in the tuned signals to be displayed and/or reproduced on a screen of the display panel 88. Here, "screen" quoted herein can be stated to correspond to the phosphor film 84 in the display panel 88 shown in FIG. 11. This configuration can configure information display reproduction apparatus such as a television. Of course, in the case where the broadcast signals are encoded, the information display reproduction apparatus of the present invention can also include a decoder. In addition, audio signals are outputted to audio reproducing means such as a separately provided speaker and the like and are reproduced in synchronization with video information and text information displayed on the display panel 88.

In addition, a method of outputting video information or text information onto the display panel 88 to display and/or reproduce it can be carried out as follows, for example. Firstly, image signals corresponding with respective pixels of the display panel 88 are generated based on the video information and text information in receipt. And the generated image signals are inputted to a drive circuit of the display panel 88. And, a voltage applied from the drive circuit to each electron-emitting device inside the display panel 88 is controlled based on the image signals inputted to the drive circuit and thereby images are displayed.

Figure 13:
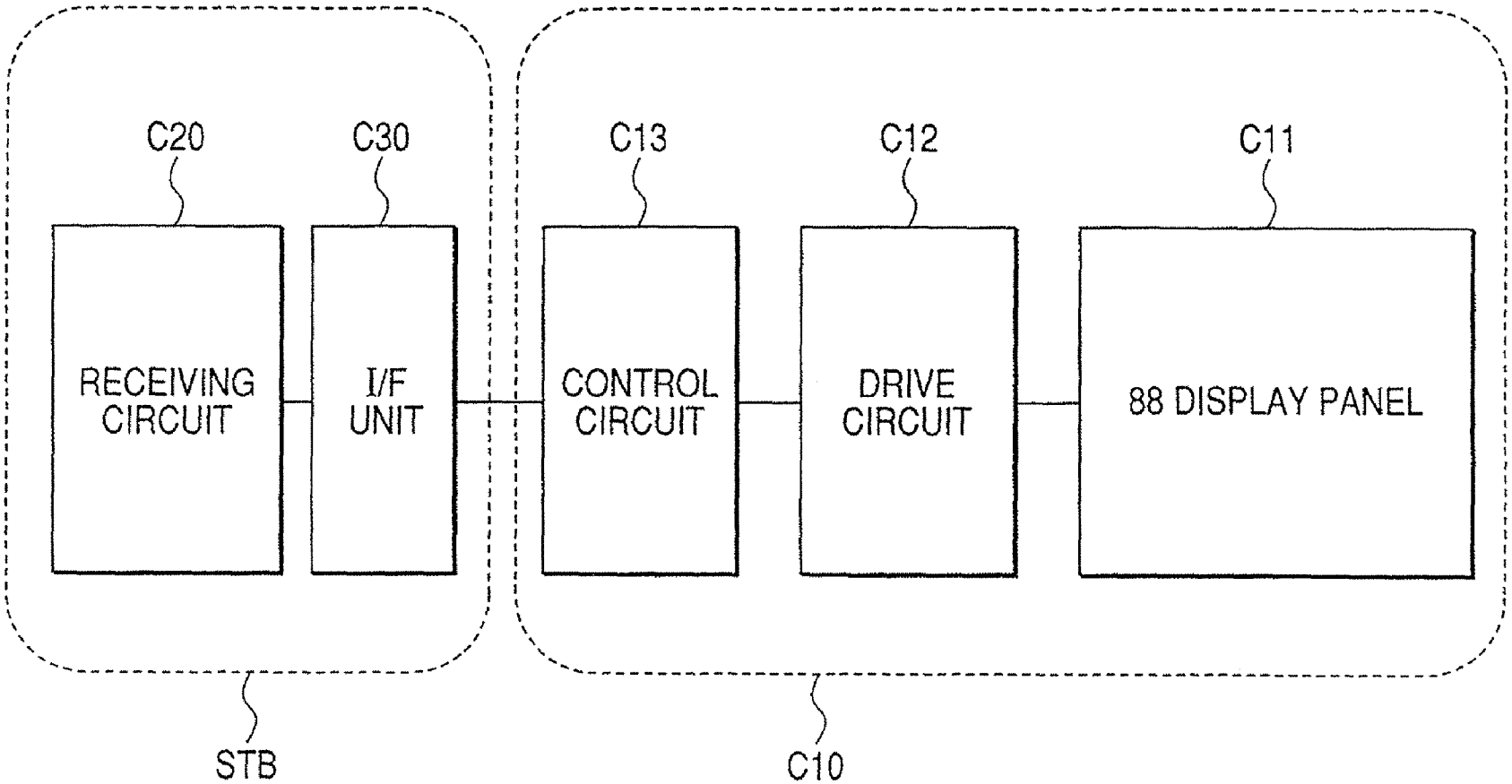
FIG. 13 is a block diagram of an apparatus of receiving information signals of such as a television broadcast and the like to display or reproduce them.

FIG. 13 is a black diagram of a television apparatus related to the present invention. The receiving circuit is configured by a tuner, a decoder and the like; receives television signals of such as satellite broadcasts, terrestrial broadcasts and the like and data broadcasts and the like through networks; and outputs the decoded video data to an I/F unit (interface unit). The I/F unit converts video data into a display format of a display apparatus to output the image data to the above described display panel 88. The image display apparatus includes a drive circuit and a control circuit. The control circuit carries out image processing such as adjustment operation and the like appropriate for a display panel on the inputted image data and outputs the image data and respective kinds of control signals to the drive circuit. The drive circuit outputs drive signals to each wiring (see the wiring Dox1 to Doxm and the wiring Doy1 to Doyn in FIG. 11) of the display panel 88 based on the inputted image data and a television video is displayed. The receiving circuit and the I/F unit may be housed in an enclosure separate from the image display apparatus as a set top box (STB) and may be housed in the same enclosure together with the image display apparatus.

In addition, the interface can be configured connectable to an image storage apparatus and an image output apparatus selected from the group consisting of a printer, a digital video camera, a digital camera, a hard disc drive (HDD), a digital video disk (DVD) and the like. And, thus, the image stored in the image storage apparatus can be displayed on the display panel 88. In addition, the information display reproduction apparatus (or television) can be configured to be capable of processing images displayed on the display panel 88 corresponding with necessity and outputting them to an image output apparatus.

The configuration of the information display reproduction apparatus described herein is an example and various variations are feasible based on the technological ideas of the present invention. In addition, the information display reproduction apparatus of the present invention can be connected to a teleconference system and a system such as a computer and the like to thereby configure various information display reproduction apparatuses.

EXAMPLES

The present invention will be described in detail with specific examples below, but the present invention will not be limited to those examples but displacement and design changes on each element can be carried out within such a range that the objects of the present invention are attained.

Example 1

Figure 14A:
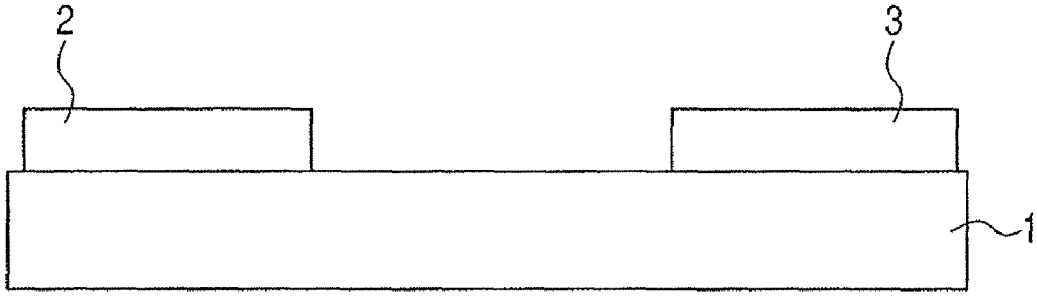
FIG. 14A, FIG. 14B and FIG. 14C show schematically an example of a method of fabricating an electron-emitting device of the present invention.
Figure 14B:
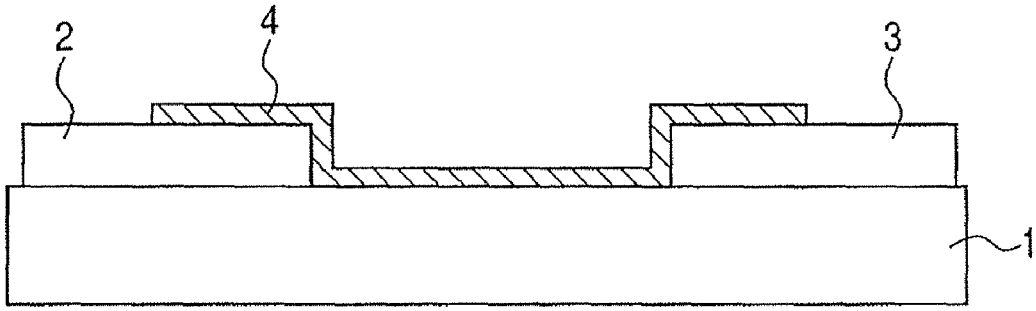
Figure 14C:
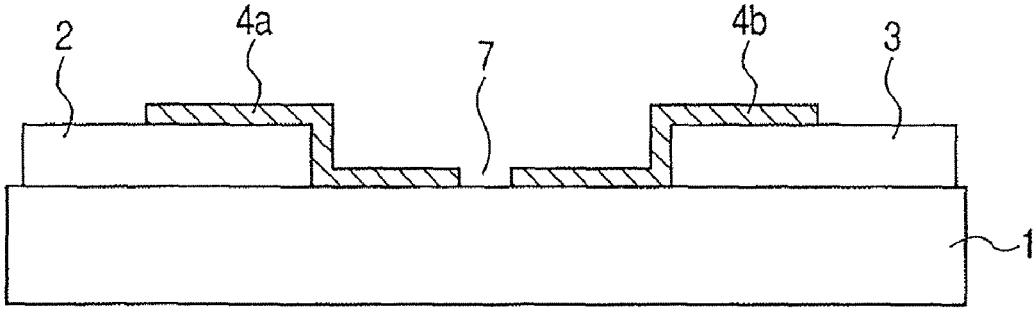
Figure 15A:
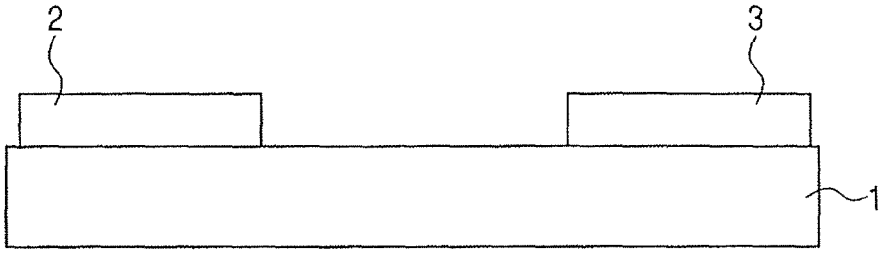
FIG. 15A PRIOR ART
FIG. 15A, FIG. 15B, FIG. 15C and FIG. 15D show schematically an example of a method of fabricating a conventional electron-emitting device.
Figure 15B:
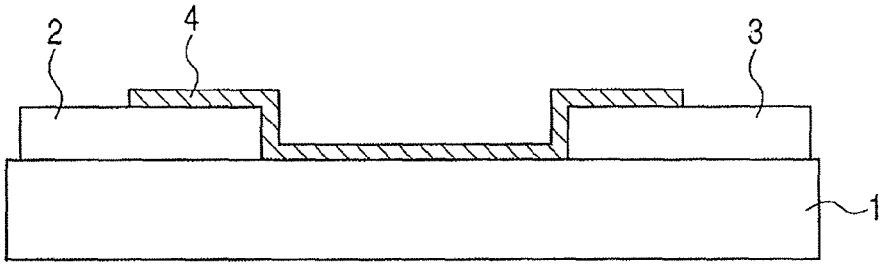
FIG. 15B PRIOR ART
Figure 15C:
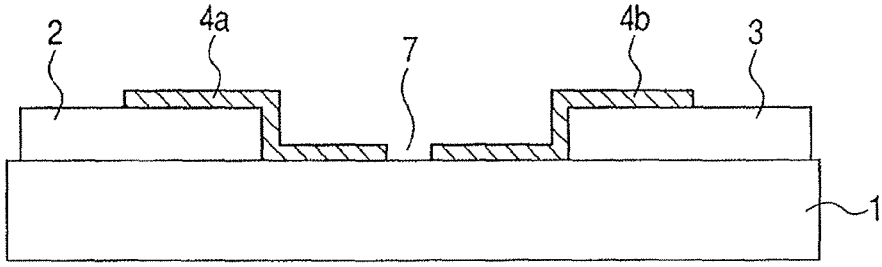
FIG. 15C PRIOR ART
Figure 15D:
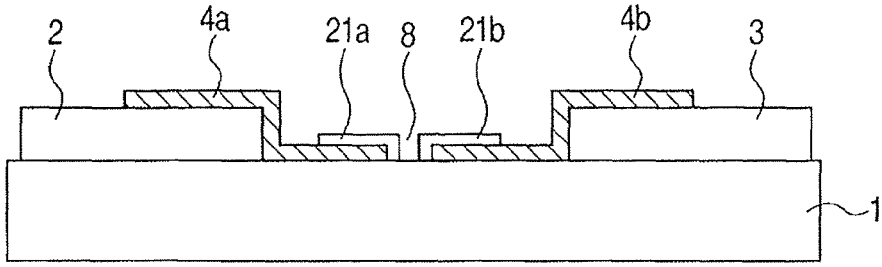
FIG. 15D PRIOR ART
Figure 16A:
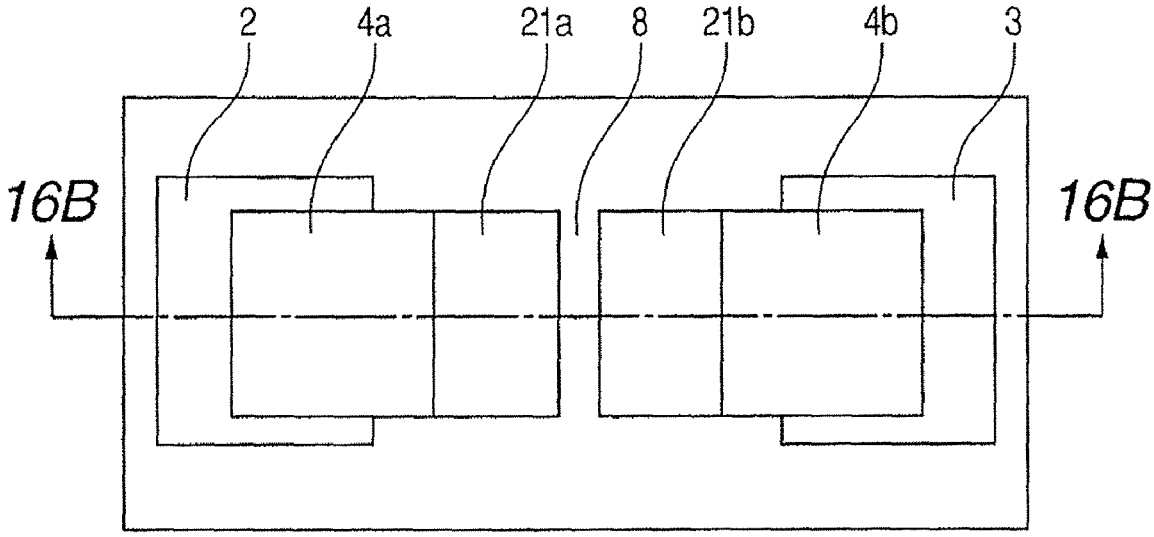
FIG. 16A PRIOR ART
FIG. 16A and FIG. 16B show schematically plan view and section of a conventional electron-emitting device.
Figure 16B:
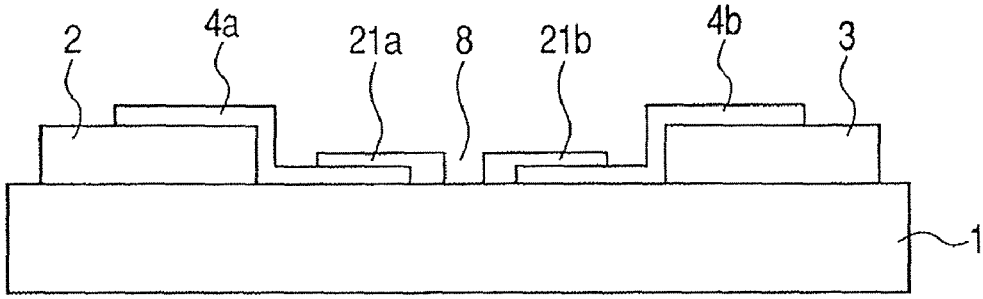
FIG. 16B PRIOR ART

A method of producing the electron-emitting device of the present example will be described with FIG. 14A to FIG. 14C.

(Process-a)

A silicon oxide layer is deposited on soda lime glass with the sputtering method and this is taken as a substrate 1. Subsequently, after cleaning that substrate 1, Ti with thickness of 5 nm and Pt with thickness of 25 nm are successively deposited with vacuum evaporation method and thereafter undergo patterning with photolithography technology to form auxiliary electrodes (2 and 3) (FIG. 14A). The distance L between the auxiliary electrodes was set to 10 μm. Thus, the first auxiliary electrode 2 and the second auxiliary electrode 3 were disposed on the substrate 1. And, electroconductive film 4 linking the first auxiliary electrode 2 and the second auxiliary electrode 3 was formed (FIG. 14B). The electroconductive film 4 is configured by a large number of CoO particles and a large number of Pd particles and was made with the sputtering method. CoO particles and Pd particles are nonhomogeneously mixed in the electroconductive film 4. The width W' of the electroconductive film 4 (see FIG. 2A) was set to 60 μm respectively.

Here, controlling the deposition time for respective material, containing ratio (composition ratio) of CoO particles to Pd particles contained in the electroconductive film 4 was changed to produce five kinds of electroconductive film 4 (see the below described (table 1)). That is, five samples (each comprising any one of five kinds of electroconductive film 4 shown in the below described (table 1) and the first as well as the second auxiliary electrodes connected to that electroconductive film) were produced with the above described process-a. Here, in the present example, resistance of cobalt oxide to resistance of palladium is 150 (CoO:Pd=150:1). The resistance of CoO and the resistance of Pd can be obtained with the samples No. 1 and No. 5 shown in the table 1. Exactly as described above, the resistance of the respective particles (CoO and Pd) can be measured utilizing the contact mode of the AFM. In addition, the containing ratio (area occupancy) can be measured with the FE-AES.

TABLE 1

| No. | CoO containing ratio | Pd containing ratio | Resistance (electroconductive film) |
|---|---|---|---|
| 1 | 100% | 0% | 30 kΩ |
| 2 | 60% | 40% | 7.5 kΩ |
| 3 | 50% | 50% | 5 kΩ |
| 4 | 30% | 70% | 1.2 kΩ |
| 5 | 0% | 100% | 200 Ω |

Here, film thickness of the five kinds of electroconductive film 4 (No. 1 to No. 5) was formed so as to give rise to average 15 nm respectively. In addition, the average particle sizes of the first particles and the second particles configuring the five kinds of electroconductive film 4 were both 15 nm and the standard deviation of the particle size was 2 nm. That is, the standard deviation of the particle size was 13.3%.

Each of the above described five samples underwent the following process-b and process-c inside a vacuum container 55 shown in FIG. 8.

(Process-b)

A voltage pulse was applied between the first auxiliary electrode 2 and the second auxiliary electrode 3 to carry out the "energization forming" operation. Here, the pressure inside the vacuum container 55 was maintained at not more than $10^{-5}$ Pa. As for the pulse waveform, a triangular wave pulse with the crest value gradually increasing shown in FIG. 3B was used. Here, the pulse width of T1=1 msec and the pulse interval of T2=10 msec. were adopted.

For the sample comprising the electroconductive film 4 of No. 1, the gap 7 was formed with the crest value 50 V and the formed first gap 7 was not successive but was in the discrete state.

For the sample comprising the electroconductive film 4 of No. 2, the gap 7 was formed with the pulse crest value 20 V.

For the sample comprising the electroconductive film 4 of No. 3, the gap 7 was formed with the pulse crest value 15 V.

For the sample comprising the electroconductive film 4 of No. 4, the gap 7 was formed with the pulse crest value 8 V.

For the sample comprising the electroconductive film 4 of No. 5, the gap 7 was formed with the pulse crest value 5 V, but the formed first gap 7 did not reach from one end to the other end in the direction of width (W') of the electroconductive film 4 (see FIG. 2A).

Resistance values between the first auxiliary electrode 2 and the second auxiliary electrode 3 of the samples comprising the electroconductive film 4 of No. 2 to No. 4 were measured to find that the resistance values between the first auxiliary electrode 2 and the second auxiliary electrode 3 increased by not less than two digits (not less than 100 times) before and after "energization forming" operations. In addition, as a result of observation on the mode of the gap 7 with an electron microscope, in the case of the samples comprising the electroconductive film 4 of No. 2 to No. 4, the gap 7 was formed successive from one end to the other end of the electroconductive film 4 in the direction substantially perpendicular to the direction in which the auxiliary electrode 2 faces the auxiliary electrode 3.

On the other hand, for the electroconductive film 4 of No. 1, as shown in FIG. 6A, a plurality of split (discrete) gaps have been formed and, also in macroscopic view, the electroconductive film 4 was not split sufficiently. In addition, width of the formed gap 7 (length in the direction in which the auxiliary electrode 2 faces the auxiliary electrode 3) is very wide as well and even if the "activation" operation to be described below has been carried out, sufficient electron-emitting properties were not obtainable. And for the electroconductive film 4 of No. 5, a plurality of split (discrete) gaps were formed as shown in FIG. 6C. In addition, for the samples comprising electroconductive film 4 of No. 1 and No. 5, the resistance values between the auxiliary electrode 2 and the auxiliary electrode 3 after the "energization forming" operation remained around 10 times larger than the resistance value prior to the "energization forming" operation.

(Process-c)

Subsequent to the above described process-b, the samples comprising the above described electroconductive film of No. 2 to No. 4 underwent "activation" operations. Specifically, introducing trinitrile gas into the vacuum container 55, a voltage pulse of a rectangular wave with the crest value of 20 V was repeatedly applied between the auxiliary electrode 2 and the auxiliary electrode 3 while inversing the potential relationship between the auxiliary electrode 2 and the auxiliary electrode 3 periodically. Here, the pulse width and the pulse interval were set to 1 msec. and 10 msec. respectively. Consequently, for any of the samples, the current flowing between the auxiliary electrode 2 and the auxiliary electrode 3 increased with time. The "activation" operation finished at the point of time when the current flowing between the auxiliary electrode 2 and the auxiliary electrode 3 reached around 1 mA. Carrying out the "activation" operation, first carbon film 21*a* and second carbon film 21*b* were formed in any of the samples as shown in FIG. 1C. Here, a second gap 8 was formed between the first carbon film 21*a* and the second carbon film 21*b* and a concave portion 22 was formed on the surface of the base 1 located inside the second gap 8.

(Process-d)

Subsequent to the process-c, the samples of No. 2 to No. 4 together with the vacuum container 55 underwent a heating operation. Here, during the heating operation, exhaust inside the vacuum container 55 was continued. That operation is called "activation" operation. At the point of time when pressure inside the vacuum container 55 reached not more than $1.3\times10^{-6}$ Pa, the "activation" operation finished.

The electron-emitting devices with the electroconductive film of No. 2 to No. 4 were produced through the above described process.

Subsequently, electron-emitting properties were measured on the above described electron-emitting devices in state of maintaining the vacuum level formed with the above described "activation" operation. Measurement was carried out by applying a voltage pulse between the auxiliary electrode 2 and the auxiliary electrode 3 with a power supply 51 and applying 1 KV to the anode electrode 54. The distance H between the anode electrode 54 and the device was set to 4 mm. Consequently, together with non-linear voltage-device current properties likewise in FIG. 9, good electron-emitting properties were observed.

Comparative Example 1

For a comparative example 1, palladium oxide film was used as electroconductive film 4. And, the "energization forming" operation was carried out in an atmosphere containing hydrogen gas being reducible gas. Otherwise, the film likewise the example 1 was produced.

Here, as electroconductive film 4 for the comparative example 1, three kinds of palladium oxide film were used as shown in the following table 2. That is, three samples (each of which is configured by any one of the three kinds of electroconductive film 4 shown below (the table 2) and the first as well as the second auxiliary electrodes connected to the electroconductive film) were produced. Here, width W' of the electroconductive film 4, distance L between the auxiliary electrodes and the like (see FIG. 2A) was set likewise the example described above. In addition, "resistance" in (the table 2) corresponds to the resistance value between the auxiliary electrodes.

TABLE 2

| No. | Average film thickness | Resistance |
|---|---|---|
| 6 | 15 nm | 3 kΩ |
| 7 | 10 nm | 20 kΩ |
| 8 | 5 nm | 40 kΩ |

In the "energization forming" operation, the vacuum container 55 was exhausted in its inside to not more than $10^{-5}$ Pa; thereafter reducible gas ($N_2$:98% and $H_2$:2%) was introduced until the pressure inside the vacuum container 55 reached $1.3\times10^{-3}$ Pa; and a voltage pulse was applied a plurality of times between the auxiliary electrode 2 and the auxiliary electrode 3. The pulse waveform used in the "energization forming" operation was different from that of the example described above and a triangular wave pulse with a constant crest value shown in FIG. 3A was taken. Pulse width of T1=1 msec. and pulse interval of T2=10 msec. was adopted.

Results of the "energization forming" operation on each sample of the present comparative example are shown in the below described table 3. Here, five same sheets of the electroconductive film 4 of No. 6 were provided (No. 6-1 to No. 6-5). And, the five sheets of the electroconductive film 4 of No. 6-1 to No. 6-5 underwent the "energization forming" operation with respectively different voltage values (2 V, 10 V, 8 V, 25 V and 30 V).

Here, on the occasion of the "energization forming" operation, the maximum current flowing between the auxiliary electrode 2 and the auxiliary electrode 3 is defined as the forming current: $I_{form}$ and the voltage applied between the auxiliary electrode 2 and the auxiliary electrode 3 then is defined as the forming voltage: $V_{form}$. And the sum of the above described forming current and the forming voltage is defined as the forming power: $P_{form}$. In addition, the time required from the start of the "energization forming operation until the resistance value of the electroconductive film 4 (the resistance value between the auxiliary electrode 2 and the auxiliary electrode 3) reaches a resistance value 1000 times larger than the resistance value of the electroconductive film 4 prior to the "energization forming" operation is defined as the forming time: $T_{form}$.

TABLE 3

| No. | $I_{form}$ [mA] | $V_{form}$ [V] | $P_{form}$ [mW] | $T_{form}$ [sec] |
|---|---|---|---|---|
| 6-1 | 30 | 30 | 900 | 0.01 |
| 6-2 | 20 | 25 | 500 | 0.1 |
| 6-3 | 10 | 18 | 180 | 500 |
| 6-4 | 5 | 10 | 50 | 1600 |
| 6-5 | 100 | 2 | 200 | 3500 |
| 7 | 2 | 20 | 40 | 1500 |
| 8 | 2 | 25 | 50 | 1300 |

At first, results with electroconductive film 4 of No. 6 (No. 6-1 to No. 6-5) will be described.

In the case of No. 6-4 with Vform being 10 V, $P_{form}$ is found to take the minimum value. Thus, in the case of using palladium oxide being metal oxide for the electroconductive film 4, execution of "energization forming" operation in reducible (or aggregating) gas is found to be capable of dropping $V_{form}$ and consequently dropping $P_{form}$.

Next, the electroconductive film 4 (No. 7 and No. 8) with resistance higher than that of the electroconductive film of No. 6 will be described. Here, in the table 3, only the conditions to make the $P_{form}$ minimum are shown. The cases where mutually different voltages (20V and 25V) were applied to the electroconductive film 4 are shown.

For the samples with the electroconductive film 4 of No. 7 and No. 8, any case is found to require $T_{form}$ of around 1000 to 2000 sec but be capable of drop $P_{form}$.

Here, for the samples of No. 6 to No. 8, when an "energization forming" operation was tried without using reducible gas, the forming operation could not be finished within an hour at the forming voltage of 2 V to 25 V. That is, utilization of the reducible gas is found to be indispensable for reducing power and shortening operation time in the "energization forming" operation.

Next, the result of implementing likewise examination on the samples comprising the electroconductive film 4 of No. 1 to No. 5 shown in the examples will be shown in the below described table 4. Here, the pulse waveform used in the "energization forming" operation was different from that of the example described above and a triangular wave pulse with a constant crest value shown in FIG. 5A was taken. Pulse width of T1=1 msec. and pulse interval of T2=10 msec. was adopted. In addition, at the time of "energization forming" operation, unlike the comparative example described above, no reducible gas is used.

TABLE 4

| No. | $I_{form}$ [mA] | $V_{form}$ [V] | $P_{form}$ [mW] | $T_{form}$ [sec] |
|---|---|---|---|---|
| 1 | 2.6 | 50 | 130 | 0.01 |
| 2 | 2.6 | 20 | 52 | 0.01 |
| 3 | 3 | 15 | 45 | 0.01 |
| 4 | 7 | 8 | 56 | 0.01 |
| 5 | 25 | 5 | 125 | 0.01 |

As the containing ratio of Pd in the electroconductive film 4 gets higher, $V_{form}$ can be made lower. However, in the case of the samples with the electroconductive film of No. 1 and No. 5, as described in the example described above, even if the "activation" operation has been carried out, sufficient electron-emitting amount is not obtainable.

Here, the point of particular importance is that, for the samples with the electroconductive film of No. 2 to No. 4, $P_{form}$ is small on the level around 50 mW and $T_{form}$ is very short on the level of 0.01 sec. Since $T_{form}$ is 0.01 sec; pulse width is T1=1 msec.; and the pulse interval is T2=10 msec., a good gap 7 is found to be formable with application of a voltage pulse substantially only once.

As described for the comparative example, in the case of carrying out the "energization forming" operation on the electroconductive film 4 of conventional metal oxide, accompanying introduction of gas promoting reduction (or aggregation) of the electroconductive film, low $P_{form}$ of around 50 mW can be realized at last. However, with the electroconductive film (for example, electroconductive film of No. 2 to No. 4) of the present invention, low $P_{form}$ can be realized without using reducible gas. And, in addition, there is no need to reduce the electroconductive film made of metal oxide, short $T_{form}$ can be realized.

Here, using reducible gas for the "energization forming" operation with the electroconductive film 4 of No. 2 to No. 4, forming power occasionally became larger against intention. The reason thereof is considered that the electroconductive mechanism of the electroconductive film 4 has changed. Therefore, in the present invention, the atmosphere in the "energization forming" operation is practically maintained at pressure of not more than $10^{-5}$ Pa to contribute to form a stable gap 7 and therefore is preferable.

In addition, the electron-emitting properties of the samples of No. 2 to No. 4 and the electron-emitting properties after the "activation" operation and the "stabilization" operation likewise those for the example 1 were carried out on the sample of No. 6-3 were approximately equivalent. Moreover, a fluctuation of the electron-emitting amount was less rather than that of the samples of No. 2 to No. 4. A reason hereof is inferred that the electroconductive film for the sample of No. 6-3 has been reduced at the time of the "energization forming" operation and, in contrast, the electroconductive film for the samples of No. 2 to No. 4 is not reduced but remains highly resistive.

Thus, according to the present invention, in the "energization forming" operation, low power ($P_{form}$) and short operation time ($T_{form}$) can be balanced and good electron-emitting properties are obtainable.

Example 2

The present example is an example with standard deviation in particle size being larger than the example 1.

(Process-a)

Since an oxide silicon layer, auxiliary electrodes (2 and 3) and electroconductive film 4 are formed on soda lime glass likewise those in the example 1, description thereof will be omitted here. In addition, electrode thickness, electrode distance L, width W' of electroconductive film 4 is likewise in the example 1.

Here, controlling respective sputter power for CoO and Pd, samples were produced to comprise CoO and Pd contained in the electroconductive film 4 having particle sizes different from those of the example 1 (see the below described (table 5)). The average particle sizes of CoO and Pd were both set to 15 nm with standard deviation of 5 nm which has been made large than the standard deviation in the example 1. Average film thickness of the electroconductive film 4 is 15 nm as well. Here, in the present example, proportion of resistance of cobalt oxide (CoO) being the first particle to resistance of palladium (Pd) being the second particle is CoO:Pd=150:1 likewise in the example 1.

TABLE 5

| No. | CoO containing ratio | Pd containing ratio | Resistance (electroconductive film) |
|---|---|---|---|
| 9 | 100% | 0% | 40 kΩ |
| 10 | 60% | 40% | 6 kΩ |
| 11 | 50% | 50% | 4 kΩ |
| 12 | 30% | 70% | 1.5 kΩ |
| 13 | 2% | 98% | 400 Ω |
| 14 | 0% | 100% | 300 Ω |

Each of the above described six samples (No. 9 to No. 14) underwent "energization forming" operation (process-b), "activation" operation (process-c) and "stabilization" operation (process-d) to be described below.

(Process-b)

A voltage pulse was applied between the first auxiliary electrode 2 and the second auxiliary electrode 3 to carry out the "energization forming" operation. Pressure inside the vacuum container and a pulse applied to the electroconductive film is likewise in the example 1, description thereon will be omitted here.

For the sample comprising the electroconductive film 4 of No. 9, the gap 7 was formed with the crest value 100 V. However, the formed gap 7 comprised a plurality of split (discrete) gaps.

For the sample comprising the electroconductive film 4 of No. 10, the gap 7 was formed with the pulse crest value 25 V.

For the sample comprising the electroconductive film 4 of No. 11, the gap 7 was formed with the pulse crest value 16 V.

For the sample comprising the electroconductive film 4 of No. 12, the gap 7 was formed with the pulse crest value 10 V.

For the sample comprising the electroconductive film 4 of No. 13, the gap 7 was formed with the pulse crest value 5 V.

For the sample comprising the electroconductive film 4 of No. 14, the gap 7 was formed with the pulse crest value 5 V.

However, the formed first gap 7 did not reach from one end to the other end in the direction of width (W') of the electroconductive film 4 (see FIG. 2A).

Resistance values between the first auxiliary electrode 2 and the second auxiliary electrode 3 of the samples comprising the electroconductive film 4 of No. 10 to No. 13 were measured to find that the resistance values between the first auxiliary electrode 2 and the second auxiliary electrode 3 increased by not less than two digits (not less than 100 times) before and after "energization forming" operations. In addition, as a result of observation on the mode of the gap 7 with an electron microscope, in the case of the samples comprising the electroconductive film 4 of No. 10 to No. 13, one gap 7 was formed successive from one end to the other end of the electroconductive film 4 in the direction substantially perpendicular to the direction in which the auxiliary electrode 2 faces the auxiliary electrode 3.

On the other hand, for the electroconductive film 4 of No. 9, as shown in FIG. 6A, a plurality of split (discrete) gaps have been formed and, also in macroscopic view, the electroconductive film 4 was not split. In addition, width of the formed gap 7 (length in the direction in which the auxiliary electrode 2 faces the auxiliary electrode 3) is very wide as well and even if the "activation" operation to be described below has been carried out, desired electron-emitting properties were not obtainable. And for the electroconductive film 4 of No. 14, a plurality of mutually split gaps were formed as shown in FIG. 6C. In addition, for the samples comprising electroconductive film 4 of No. 9 and No. 14, the resistance values between the auxiliary electrode 2 and the auxiliary electrode 3 after the "energization forming" operation remained around 10 times larger than the resistance value prior to the "energization forming" operation.

(Process-c)

Subsequent to the above described process-b, the samples comprising the above described electroconductive film of No. 10 to No. 13 underwent "activation" operations. Pressure inside the vacuum container (introduced gas) and a pulse applied to the electroconductive film is likewise in the example 1, description thereon will be omitted here.

For any of the samples, the current flowing between the auxiliary electrode 2 and the auxiliary electrode 3 increased with time. The "activation" operation finished at the point of time when the current flowing between the auxiliary electrode 2 and the auxiliary electrode 3 reached around 1 mA. Carrying out the "activation" operation, first carbon film 21*a* and second carbon film 21*b* were formed in any of the samples as shown in FIG. 1C. Here, a second gap 8 was formed between the first carbon film 21*a* and the second carbon film 21*b* and a concave portion 22 was formed on the surface of the base 1 located inside the second gap 8.

(Process-d)

Subsequent to the process-c, the "stabilization" operation likewise in the example 1 was carried out.

The electron-emitting devices with the electroconductive film of No. 10 to No. 13 were produced through the above described process. Electron-emitting properties were measured in state of maintaining the vacuum level formed with the "stabilization" operation and, consequently, non-linear voltage-device current properties likewise in FIG. 9 were observed.

However, the electron-emitting properties (electron-emitting amount in particular) of the sample of No. 10 were lower than the electron-emitting properties of the sample of No. 2 in the example 1. The other samples are lower in electron-emitting properties than those in example 1, but remarkable decrease in electron-emitting properties as in the sample of No. 10 did not appeared. This is considered attributable to that standard deviation of the samples of the example 2 is larger than that of the samples of the example 1.

As described above, in the case where the standard deviation is significant, the conditions demanded to the electroconductive film 4 will become slightly different from those for the example 1.

As a result of the present example, in the case of the resistance ratio being 150 allowing the standard deviation up to 33.3% ($\neq$5 nm/15 nm$\times$100) of the average particle size, the ratio of the first particle contained in the electroconductive film 4 being set to fall within the range of not less than 2% and not more than 50% makes good electron-emitting properties obtainable.

Here, the case with resistance ratio being 150 was described but, if the resistance ratio falls within the range of not less than 50 and not more than 400; if the standard deviation is not more than 33.3%; and if the ratio of the first particle is set to fall within the range of not less than 2% and not more than 50%, good electron-emitting properties are obtainable.

Example 3

The present example is an example in the case where particles configuring the electroconductive film 4 are different from those of the example 1 and the example 2 in resistance ratio and particle size. The producing process is almost likewise in the example 1 and the example 2 and therefore only different portions will be described below.

(Process-a)

Since an oxide silicon layer, auxiliary electrodes (2 and 3) and electroconductive film 4 are formed on soda lime glass likewise those in the example 1, description thereof will be omitted here. In addition, electrode thickness, electrode distance L, width W' of electroconductive film 4 is likewise in the examples 1 and 2.

Here, controlling respective sputter time for respective material, samples were produced to comprise CoO and Pd contained in the electroconductive film 4 having particle sizes different from those of the example 1 and the example 2 (see the below described (table 6)). In addition, for any of the samples, the containing ratio of CoO contained in the electroconductive film 4 was set to 2%.

Here, in the present example, the proportion of resistance of cobalt oxide to resistance of palladium was set to 10:1 for the sample of No. 15; 50:1 for the sample of No. 16; 150:1 for the sample of No. 17; 400:1 for the sample of No. 18; and 1000:1 for the sample of No. 19 respectively. In addition, the average particle size (corresponding to average film thickness of the electroconductive film 4) of cobalt oxide and palladium in each sample was set to 5 nm for the sample of No. 15; 7 nm for the sample of No. 16; 15 nm for the sample of No. 17; 20 nm for the sample of No. 18; and 50 nm for the sample of No. 19. The standard deviation of particle size in each sample was set to 13.3% of the average particle size.

TABLE 6

| No. | CoO containing ratio | Pd containing ratio | Film thickness | Resistance (electroconductive film) |
|---|---|---|---|---|
| 15 | 2% | 98% | 5 nm | 1200 Ω |
| 16 | 2% | 98% | 7 nm | 800 Ω |
| 17 | 2% | 98% | 15 nm | 300 Ω |
| 18 | 2% | 98% | 20 nm | 130 Ω |
| 19 | 2% | 98% | 50 nm | 50 Ω |

The above described five samples respectively underwent the "energization forming" operation (process b) inside the vacuum container 55 shown in FIG. 8 and good gaps 7 were formed in all the samples.

In addition, likewise in the example 1 and the example 2, the samples comprising electroconductive film of No. 15 to No. 19 underwent the "activation" operations and the "stabilization" operations. Thereafter, electron-emitting properties were measured in state of maintaining the vacuum level formed with the "stabilization" operation and, consequently, good electron-emitting properties likewise those of the samples 2 to 4 of the example 1 and the samples 11 to 13 of the example 2 were observed in the samples of No. 15 to No. 18. However, the sample of No. 19 was lower in electron-emitting properties than the example 1 and the example 2. This is inferred attributable to the average particle size and the standard deviation.

Example 4

Likewise the example 2, the example 4 is an example with standard deviation in particle size made larger than the example 3. The case where standard deviation in particle size was set to 33.3% of the average particle size for each sample in example 4 will be described.

(Process-a)

Since an oxide silicon layer, auxiliary electrodes (2 and 3) and electroconductive film 4 are formed on soda lime glass likewise those in the example 1, description thereof will be omitted here. In addition, electrode thickness, electrode distance L, width W' of electroconductive film 4 is likewise in the examples 1 and 2.

Here, controlling respective sputter time and sputter power for respective material of CoO and Pd, the average particle sizes (corresponding to film thickness in the below described [Table 7] of CoO and Pd contained in the electroconductive film 4 were controlled. Here, for any of the samples, the containing ratio of CoO was set to 2%.

Here, in the present example, the proportion of resistance of cobalt oxide to resistance of palladium was set to 10:1 for the sample 20; 50:1 for the sample 21; 150:1 for the sample 22; 400:1 for the sample 23; and 1000:1 for the sample 24 respectively. The resistance ratio is likewise that in the example 3 and the standard deviation (σ) was set to 33.3%.

TABLE 7

| No. | CoO containing ratio | Pd containing ratio | Film thickness | Resistance (electroconductive film) |
|---|---|---|---|---|
| 20 | 2% | 98% | 5 nm | 1500 Ω |
| 21 | 2% | 98% | 7 nm | 1000 Ω |
| 22 | 2% | 98% | 15 nm | 400 Ω |
| 23 | 2% | 98% | 20 nm | 200 Ω |
| 24 | 2% | 98% | 50 nm | 60 Ω |

The above described five samples respectively underwent the energization forming operation (process b) inside the vacuum container 55 shown in FIG. 8.

(Process-b)

A voltage pulse was applied between the first auxiliary electrode 2 and the second auxiliary electrode 3 to carry out the "energization forming" operation. Pressure inside the vacuum container and a pulse applied to the electroconductive film 4 is likewise in the example 1, description thereon will be omitted here.

For the sample comprising the electroconductive film 4 of No. 20, the gap 7 was formed with the pulse crest value 10 V, but dispersion in width of the formed first gap 7 was larger than the samples of No. 21 to No. 23.

For the sample comprising the electroconductive film 4 of No. 21, the gap 7 was formed with the pulse crest value 6 V.

For the sample comprising the electroconductive film 4 of No. 22, the gap 7 was formed with the pulse crest value 5 V.

For the sample comprising the electroconductive film 4 of No. 23, the gap 7 was formed with the pulse crest value 5 V.

For the sample comprising the electroconductive film 4 of No. 24, the gap 7 was formed with the pulse crest value 3 V, but dispersion in width of the formed first gap 7 was larger than the samples of No. 21 to No. 23.

Resistance values between the first auxiliary electrode 2 and the second auxiliary electrode 3 of the samples comprising the electroconductive film 4 of No. 21 to No. 23 were measured to find that the resistance values between the first auxiliary electrode 2 and the second auxiliary electrode 3 increased by not less than two digits (not less than 100 times) before and after "energization forming" operations. In addition, as a result of observation on the mode of the gap 7 with an electron microscope, in the case of the samples comprising the electroconductive film 4 of No. 21 to No. 23, the gap 7 was formed successive from one end to the other end of the electroconductive film 4 in the direction substantially perpendicular to the direction in which the auxiliary electrode 2 faces the auxiliary electrode 3. As for resistance values between the first auxiliary electrode 2 and the second auxiliary electrode 3 of the samples comprising the electroconductive film 4 of No. 20 to No. 24, the resistance values between the first auxiliary electrode 2 and the second auxiliary electrode 3 increased by approximately two digits before and after "energization forming" operations. In addition, width of the gap 7 formed in the electroconductive film 4 of No. 20 (length in the direction in which the auxiliary electrode 2 faces the auxiliary electrode 3) was very wide.

Subsequent to the above described process-b, the above described samples of No. 20 to No. 24 underwent the above described "activation" operations and the "stabilization" operations. Thereafter, respective electron-emitting properties were measured in state of maintaining the vacuum level formed with the above described "activation" operation. Measurement was carried out by applying a voltage pulse between the auxiliary electrode 2 and the auxiliary electrode 3 with a power supply 51 and applying 1 KV to the anode electrode 54. The distance H between the anode electrode 54 and the device was set to 4 mm. Consequently, although the samples of No. 21 to No. 23 were lower in electron-emitting properties than the samples of No. 16 to No. 19 of the example 3, good electron-emitting properties as a whole were obtainable. In addition, the samples of No. 20 and No. 24 underwent the "activation" operation but, nevertheless, were fairly lower in electron-emitting properties than the samples of No. 20 to No. 24.

As described above, in the case where the standard deviation is more significant, the conditions demanded to the electroconductive film 4 will become different from those for the example 3. As in the present example, in the case of the containing ratio of the first particle being 2%, in the case where the standard deviation is allowed up to 33.3%, good electron-emitting properties are obtainable with resistance ratio to fall within the range of not less than 50 and not more than 400. Here, the case of the containing ratio of the first particle being 2% was described, but with the containing ratio of the first particle falling within the range of not less than 2% and not more than 50%, in the case where the standard deviation of particle size is not more than 33.3% of the average particle size, good electron-emitting properties are obtainable with resistance ratio to fall within the range of not less than 50 and not more than 400.

As described above, according to the present invention, field concentrated regions can be formed in the electroconductive film of the electron-emitting device in advance, and therefore the current flowing in the electroconductive film at the time of the "energization forming" operation can be made small by a large margin and at the same time the operation time can be shortened. That is, according to the present invention, the "energization forming" operation can be carried out in fairly short time with thrifty power consumption equivalent to the use of conventional reducible gas to carry out "energization forming" operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-359074, filed Dec. 13, 2005, which is hereby incorporated by reference herein in its entirety.

What is claimed is:

1. A method of fabricating an electron-emitting device, comprising:

flowing a current through a film to form a gap in a portion of said film, the film containing (a) a plurality of first particles made of a first material and (b) a plurality of second particles having a resistance lower than a resistance of the first particle and made of a second material different from said first material, wherein said film satisfies any one of the following conditions:

(i) a contained amount of said first particles is not less than 2% and not more than 30% of a total contained amount of the first particles and the second particles, and a ratio of the resistance of said first particle to the resistance of said second particle is not less than 5 and not more than 1000;

(ii) a contained amount of said first particles is not less than 2% and not more than 40% of a total contained amount of the first particles and the second particles, and a ratio of the resistance of said first particle to the resistance of said second particle is not less than 5 and not more than 800; and (iii) a contained amount of said first particles is not less than 2% and not more than 60% of a total contained amount of the first particles and the second particles, and a ratio of the resistance of said first particle to the resistance of said second particle is not less than 5 and not more than 400.

2. The method of fabricating an electron-emitting device according to claim 1, wherein flowing said current through said film to form the gap is performed under pressure not more than $1\times10^{-5}$ Pa.

3. The method of fabricating an electron-emitting device according to claim 1, wherein said film is disposed so as to bring a first auxiliary electrode and a second auxiliary electrode into connection, a voltage pulse is applied between the first auxiliary electrode and the second auxiliary electrode and thereby said current flows through said film.

4. The method of fabricating an electron-emitting device according to claim 1, wherein said first particles and said second particles are nonhomogeneously mixed in the film.

5. The method of fabricating an electron-emitting device according to claim 1, wherein an average particle size of said first particle and second particle is not less than 5 nm and not more than 20 nm.

6. A method of fabricating an electron source comprising a plurality of electron-emitting devices, wherein each of said plurality of electron-emitting devices is fabricated with the fabrication method according to claim 1.

7. A method of fabricating an image display apparatus comprising an electron source and a light emitting member irradiated with electrons emitted from the electron source, wherein said electron source is fabricated with the fabrication method according to claim 6.

8. The method of fabricating an electron-emitting device according to claim 1, wherein the total amount is not less than 70% of an amount of the film.

9. A method of fabricating an electron-emitting device, comprising:

flowing a current through a film to form a gap in a portion of said film, the film containing (a) a plurality of first particles made of a first material and (b) a plurality of second particles having a resistance lower than a resistance of the first particle and made of a second material different from said first material, and wherein a contained amount of said first particles is not less than 2% and not more than 50% of a total contained amount of the first particles and the second particles;

a ratio of the resistance of said first particle to the resistance of said second particle being not less than 50 and not more than 400; and a standard deviation with respect to a particle size of said first particle and second particle is not more than 33.3% of an average particle size, of said first particle and second particle.

10. The method of fabricating an electron-emitting device according to claim 9, wherein flowing said current through said film to form the gap is performed under pressure not more than $1\times10^{-5}$ Pa.

11. The method of fabricating an electron-emitting device according to claim 9, wherein said film is disposed so as to bring a first auxiliary electrode and a second auxiliary electrode into connection, a voltage pulse is applied between the first auxiliary electrode and the second auxiliary electrode and thereby said current flows in said film.

12. The method of fabricating an electron-emitting device according to claim 9, wherein said first particles and said second particles are nonhomogeneously mixed in the film.

13. The method of fabricating an electron-emitting device according to claim 9, wherein an average particle size of said first particle and second particle is not less than 5 nm and not more than 20 nm.

14. A method of fabricating an electron source comprising a plurality of electron-emitting devices, wherein each of said plurality of electron-emitting devices is fabricated with the fabrication method according to claim 9.

15. A method of fabricating an image display apparatus comprising an electron source and a light emitting member irradiated with electrons emitted from the electron source, wherein said electron source is fabricated with the fabrication method according to claim 9.

16. The method of fabricating an electron-emitting device according to claim 9, wherein the total amount is not less than 70% of an amount of the film.

17. A method of fabricating an electron-emitting device, comprising;

flowing a current through a film to form a gap in a portion of said film, the film containing (a) a plurality of first particles made of a first material and (b) a plurality of second particles made of a second material having a resistivity lower than a resistivity of the first material, wherein a standard deviation with respect to a particle size of said first particles and second particles being not more than 33.3% of an average particle size of said first particle and second particle, and wherein said film satisfies any one of the following conditions:

(i) a contained amount of said first particles is not less than 2% and not more than 30% of a total contained amount of the first particles and the second particles, and a ratio of the resistivity of said first material to the resistivity of said second material is not less than 5 and not more than 1000;

(ii) a contained amount of said first particles is not less than 2% and not more than 40% of a total amount of the first particles and the second particles, and a ratio of the resistivity of said first material to the resistivity of said second material is not less than 5 and not more than 800; and (iii) a contained amount of said first particles is not less than 2% and not more than 60% of a total amount of the first particles and the second particles, and a ratio of the resistivity of said first material to the resistivity of said second material is not less than 5 and not more than 400.

18. The method of fabricating an electron-emitting device according to claim 17, wherein flowing said current through said film to form the gap is performed under pressure not more than $1\times10^{-5}$ Pa.

19. The method of fabricating an electron-emitting device according to claim 17, wherein an average particle size of said first particle and second particle is not less than 5 nm and not more than 20 nm.

20. A method of fabricating an electron source comprising a plurality of electron-emitting devices, wherein each of said plurality of electron-emitting devices is fabricated with the fabrication method according to claim 17.

* * * * *